US011793383B2

(12) United States Patent
Pampel

(10) Patent No.: US 11,793,383 B2
(45) Date of Patent: Oct. 24, 2023

(54) AWNING CLEANING TOOL

(71) Applicant: Daniel L. Pampel, Santa Barbara, CA (US)

(72) Inventor: Daniel L. Pampel, Santa Barbara, CA (US)

( * ) Notice: Subject to any disclaimer, the term of this patent is extended or adjusted under 35 U.S.C. 154(b) by 532 days.

(21) Appl. No.: 16/920,110

(22) Filed: Jul. 2, 2020

(65) Prior Publication Data

US 2021/0000318 A1 Jan. 7, 2021

Related U.S. Application Data

(60) Provisional application No. 62/870,540, filed on Jul. 3, 2019.

(51) Int. Cl.

| | |
|---|---|
| ***A47L 11/38*** | (2006.01) |
| ***A47L 11/40*** | (2006.01) |
| ***B08B 3/08*** | (2006.01) |
| ***B08B 5/04*** | (2006.01) |
| ***B08B 7/04*** | (2006.01) |
| ***B08B 11/00*** | (2006.01) |
| ***B08B 1/00*** | (2006.01) |

(52) U.S. Cl.

CPC ..... *A47L 11/38* (2013.01); *A47L 11/4041* (2013.01); *A47L 11/4044* (2013.01); *A47L 11/4075* (2013.01); *A47L 11/4088* (2013.01); *B08B 1/002* (2013.01); *B08B 3/08* (2013.01); *B08B 5/04* (2013.01); *B08B 7/04* (2013.01); *B08B 11/00* (2013.01)

(58) Field of Classification Search

CPC ..... A47L 11/38; A47L 11/40; A47L 11/4088; A47L 11/4016; A47L 11/4075; A47L 11/30; B08B 1/00; B08B 11/00; B08B 3/08; B08B 5/04; B08B 7/04

See application file for complete search history.

(56) References Cited

U.S. PATENT DOCUMENTS

| | | | | |
|---|---|---|---|---|
| 3,813,721 | A | 6/1974 | Gaudio et al. | |
| 4,138,760 | A | 2/1979 | Cadle | |
| 5,802,664 | A * | 9/1998 | Mondigo | A47L 9/0411 15/322 |
| 6,347,428 | B1 | 2/2002 | Shimko et al. | |
| 2006/0272120 | A1 | 12/2006 | Barrick et al. | |
| 2020/0165147 | A1* | 5/2020 | Murosaki | A47L 11/201 |
| 2020/0253447 | A1* | 8/2020 | Wang | A47L 11/19 |

* cited by examiner

*Primary Examiner* — Brian D Keller
*Assistant Examiner* — Sarah Akyaa Fordjour
(74) *Attorney, Agent, or Firm* — LYON & HARR, LLP; Richard T. Lyon

(57) ABSTRACT

An awning cleaning tool for cleaning awnings and other structures employing awning-like material. In one implementation, the awning cleaning tool includes a cleaning head unit having a squeegee-like leak guard, one or more powered brushes, a row of water-detergent applicator nozzles, and an elongated extraction port. The awning cleaning tool also includes an elongated extension and a control handle. During cleaning, a water-detergent mixture is sprayed via the nozzles onto the top surface of the awning and the powered brushes work the water-detergent mixture into the material of the awning to dislodge the dirt and debris. The used water-detergent mixture, dirt and debris are extracted via the extraction port. Any excess water-detergent mixture is captured by the leak guard so that it does not run down and off the awning.

12 Claims, 13 Drawing Sheets

AWNING CLEANING TOOL

BACKGROUND

Awning material manufacturers traditionally recommend cleaning the material used in awnings (such as canvas) with a mild cleaning solution applied via a soft bristle brush and hand scrubbed. The cleaning solution is then hosed off to remove it. This creates a waste cleaning solution run-off that many municipalities prohibit, thus preventing an awning from being cleaned in a conventional manner. In addition, even when the run-off is permitted, the conventional process leaves the canvas wet. In order to apply a water repellant solution to the cleaned canvas as is typically done, the canvas must dry first. This creates a situation where an awning cleaning technician is forced return once the canvas has air-dried to apply the water repellant. This can be hours later in some cases.

SUMMARY

Awning cleaning tool implementations described herein generally involve a tool for cleaning awnings such as those used for windows on commercial and residential buildings, as well as other structures employing awning-like material. In one general implementation, the awning cleaning tool includes a cleaning head unit with a downward-facing side having a proximal end and a distal end, which faces an awning surface that is to be cleaned. The cleaning head unit includes a squeegee-like leak guard that runs laterally across the downward-facing side of the cleaning head unit at the proximal end thereof and which projects outward from the downward-facing side of the cleaning head unit. There is also one or more brushes that run laterally across the downward-facing side of the cleaning head unit forward of the leak guard toward the distal end of the downward-facing side and which project outward from the downward-facing side of the cleaning head unit, and a row of water-detergent applicator nozzles that run laterally across the downward-facing side of the cleaning head unit forward of the one or more brushes toward the distal end of the downward-facing side of the cleaning head unit. Additionally, the cleaning head unit includes an elongated extraction port that run laterally across the downward-facing side of the cleaning head unit forward of the nozzles at the distal end of the downward-facing side. The general awning cleaning tool implementation also includes an elongated extension line and a control handle. This extension line includes an extension line vacuum line, an extension line water-detergent feed line, and an extension line electrical supply line, each of which is connected at a first end to the cleaning head unit. A control handle is connected at a first end to a second end of the extension line vacuum line, a second end of the extension line water-detergent feed line and a second end of the extension line electrical supply line, and whenever an awning surface is to be cleaned, the control handle is further connected at a second end to a vacuum line which is capable of applying a vacuum which draws liquid into the cleaning head unit extraction port and pulls the extracted liquid through the cleaning head unit, extension line and control handle. The control handle is also connected at a second end to a water-detergent feed line which is capable of pumping water or a water-detergent mixture through the control handle, extension line and cleaning head unit and out of the applicator nozzles, and to an electrical supply line which is capable of supplying electrical power to the cleaning head unit. The control handle also includes a control switch that that activates a cleaning mode.

In one implementation, the cleaning head unit includes a vacuum extension line connector interface located on the cleaning head unit adjacent the proximal end of the unit's downward-facing side, a water-detergent feed line connector interface located on the cleaning head unit adjacent the proximal end of the unit's downward-facing side, and an electrical supply line connector interface located on the cleaning head unit adjacent the proximal end of the unit's downward-facing side, for connecting the cleaning head unit to the extension line via an extension line vacuum coupling, an extension line water-detergent feed line coupling, and an extension line electrical supply line coupling. In addition, the control handle includes a control handle vacuum line coupling which is coupled to a second extension line vacuum coupling, a control handle water-detergent feed line coupling which is coupled to a second extension line water-detergent feed line coupling, and a control handle electrical supply line coupling which is coupled to a second extension line electrical supply line coupling. Further, the control handle is connected to the vacuum line via a second control handle vacuum line coupling, to the water-detergent feed line via a second control handle water-detergent feed line coupling, and to the electrical supply line via a second control handle electrical supply line coupling.

In another awning cleaning tool implementation, the tool includes the cleaning head unit and control handle as described previously, but instead of an elongated extension line, this implementation includes an elongated, tube-shaped, telescoping extension made of a rigid material which is attached at a first end to said cleaning head unit and at a second end to the control handle, and a cleaning tool vacuum line which is coupled at a first end to said cleaning head unit and at a second end to the control handle. More particularly, the cleaning tool vacuum line is connected to a cleaning head unit vacuum extension line connector interface via a cleaning tool vacuum line coupling. There is also a cleaning tool water-detergent feed line which is coupled to a cleaning head unit water-detergent feed line connector interface via a cleaning tool water-detergent feed line coupling, and there is a cleaning tool electrical supply line which is coupled to a cleaning head unit electrical supply line connector interface via a cleaning tool electrical supply line coupling. On the control handle, a control handle vacuum line coupling is included which is coupled to a second cleaning tool vacuum line coupling, a control handle water-detergent feed line coupling is included which is coupled to a second cleaning tool water-detergent feed line coupling, and a control handle electrical supply line coupling is included which is coupled to a second cleaning tool electrical supply line coupling.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more-detailed description that is presented below.

DESCRIPTION OF THE DRAWINGS

The specific features, aspects, and advantages of the awning cleaning tool implementations described herein can be better understood with regard to the accompanying drawings. However, it is understood that other embodiments may be utilized and structural changes may be made without departing from the scope of the awning cleaning tool.

DETAILED DESCRIPTION

Figure 1:
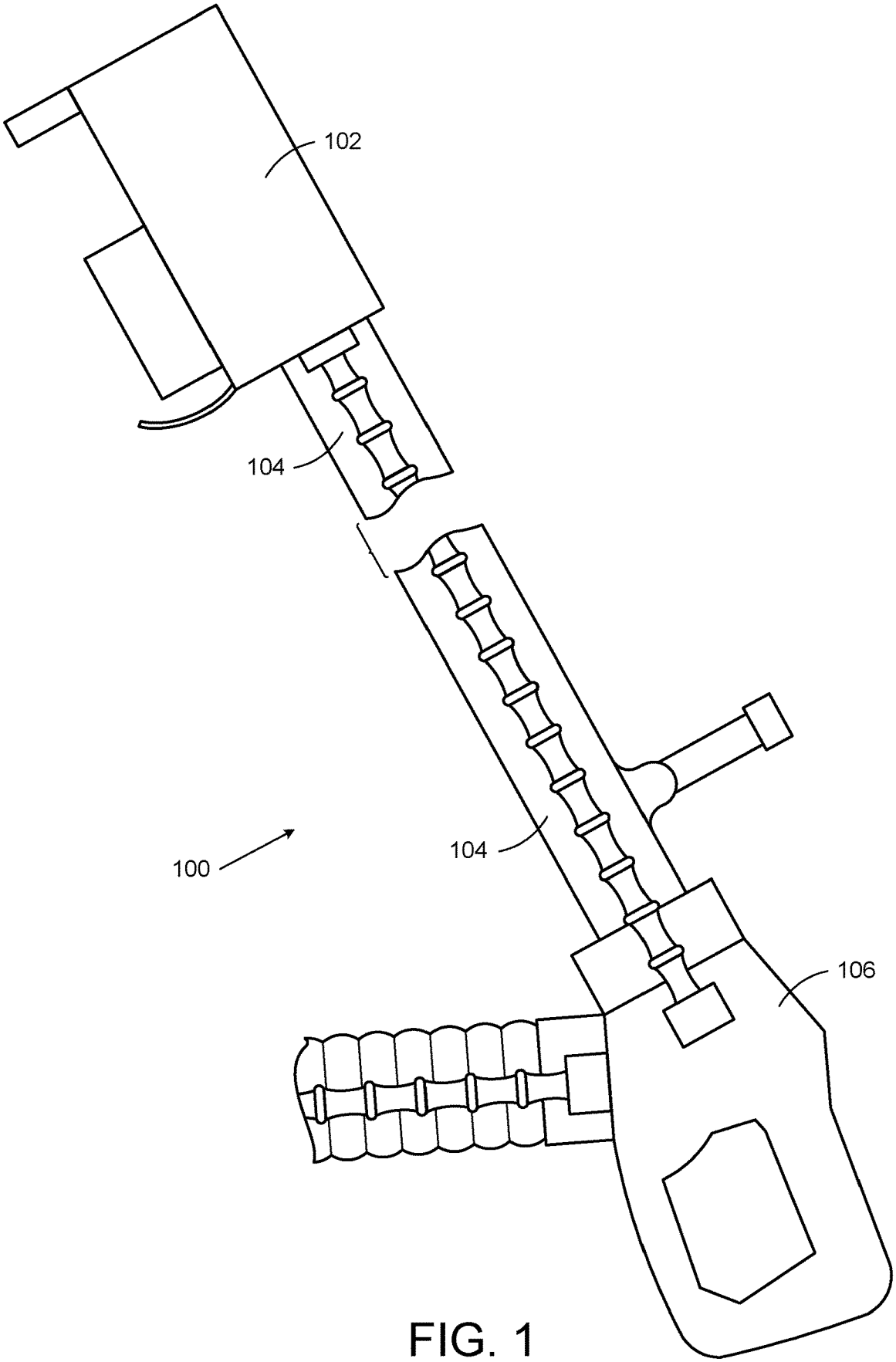
FIG. 1 is a schematic side elevation of one implementation of an awning cleaning tool.

In the following description of awning cleaning tool implementations reference is made to the accompanying drawings which form a part hereof, and in which are shown, by way of illustration, specific implementations in which the awning cleaning tool can be realized. It is understood that other implementations can be utilized and structural changes can be made without departing from the scope of the awning cleaning tool implementations.

It is also noted that for the sake of clarity specific terminology will be resorted to in describing the awning cleaning tool implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or a "tested implementation", or "one version", or "another version", or an "exemplary version", or an "alternate version", or a "tested version", or "one variant", or "another variant", or an "exemplary variant", or an "alternate variant", or a "tested variant" means that a particular feature, a particular structure, or particular characteristics described in connection with the implementation/version/variant can be included in at least one implementation of the awning cleaning tool. The appearances of the phrases "in one implementation", "in another implementation", "in an exemplary implementation", "in an alternate implementation", "in a tested implementation", "in one version", "in another version", "in an exemplary version", "in an alternate version", "in a tested version", "in one variant", "in another variant", "in an exemplary variant", "in an alternate variant", and "in a tested variant" in various places in the specification are not necessarily all referring to the same implementation/version/variant, nor are separate or alternative implementations/versions/variants mutually exclusive of other implementations/versions/variants. Yet furthermore, the order of method flow representing one or more implementations, or versions, or variants of the awning cleaning tool does not inherently indicate any particular order nor imply any limitations of the awning cleaning tool.

Furthermore, to the extent that the terms "includes," "including, "has," "contains," variants thereof, and other similar words are used in either this detailed description or the claims, these terms are intended to be inclusive, in a manner similar to the term "comprising", as an open transition word without precluding any additional or other elements.

1.0 Awning Cleaning Tool

The awning cleaning tool implementations described herein generally involve a tool for cleaning awnings such as those used for windows on commercial and residential buildings. The awning cleaning tool implementations described herein have many advantages. For example, a water-detergent mixture is sprayed onto the awning using the awning cleaning tool. It is noted that the terms "water-detergent", "water-detergent solution" and "water-detergent mixture" for the purposes of this description is defined as being just water, just detergent, or any mixture of the two. Just enough of this mixture is sprayed so as to wet the awning material and effectuate its cleaning. In addition, the used water-detergent solution is vacuumed using the awning cleaning tool as the awning is being cleaned. As such there is no run-off. This is eco-friendly and complies with any run-off restrictions that a municipality might have in place. As the water-detergent is vacuumed out of the awning material during the cleaning operation, the awning dries quickly. This allows a technician to apply water-repellant treatments to the awing almost immediately after cleaning. In addition, the overall cleaning/waterproofing time is minimized. This means that commercial businesses having their awnings cleaned can open back up faster. The lack of water-detergent run-off and faster cleaning times also makes for a safer work environment for the cleaning technicians. The awning cleaning tool is also modular in that the components can be readily assembled and disassembled on-site, and the tool is compatible with existing portable and truck-mounted cleaning systems.

Figure 2:
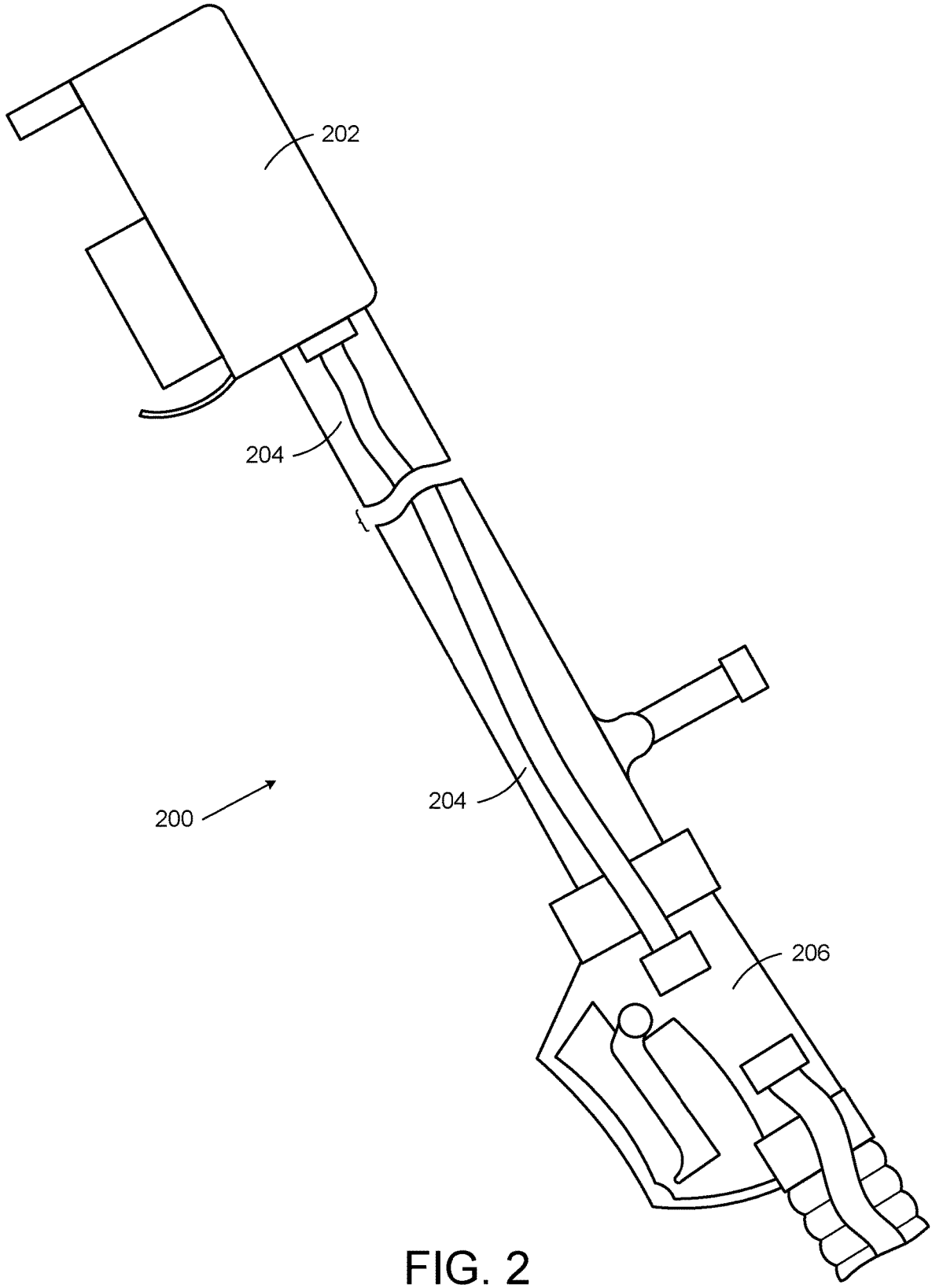
FIG. 2 is a schematic side elevation of another implementation of an awning cleaning tool.

More particularly, referring to FIG. 1, in one implementation, the awning cleaning tool 100 generally includes a cleaning head unit 102, an extension line 104 and a control handle 106. FIG. 2 shows another implementation of the awning cleaning tool 200 that again generally includes a cleaning head unit 202, an extension line 204 and a control handle 206. Note that the control handle 206 in FIG. 2 has a different configuration than the control handle 106 shown in FIG. 1. The cleaning head unit 102, 202, extension line 104, 204 and control handle 106, 206 shown in FIGS. 1 and 2 will be described in more detail in the sections to follow.

1.1 Awning Cleaning Tool with Combined Support and Vacuum Line

As will become evident in the description to follow, the implementations of the awning cleaning tool shown in FIGS. 1 and 2 employ an extension line that provides a support structure for the overall tool, as well as acting as a vacuum line for extracting the used water-detergent mixture. These implementations will be described in the immediately following sections. However, in an alternate implementation, the support and vacuum functions are split such that the awning cleaning tool has a separate vacuum line and a separate support structure. This alternate implementation will be described in more detail in later sections.

1.1.1 Cleaning Head Unit

Referring to FIGS. 3A-D, various implementations of the cleaning head unit are illustrated. In one implementation shown in FIG. 3A, the cleaning head unit 300*a* of the tool has at its proximal end a connector interface 302 for attaching to one end of an extension line. In addition, a connector interface 304 for attaching a water-detergent feed line and a connector interface 306 for attaching an electrical supply line are located on either side of the extension line segment connector interface 302. It is noted that the connector interfaces 302, 304 can located differently in alternate implementations. For example, both interfaces 302, 306 could be located on one side or the other of the interface 302. Referring again to FIG. 3A, a squeegee-like leak guard 308 runs laterally across the proximal end of the downward facing side of the cleaning head 300*a* that faces the awning surface during cleaning. The leak guard 308 prevents excess water-detergent mixture that is sprayed onto the awning from running back down the awning. For example, most awnings slant downwards from the top of the window or door frame toward the street or ground in front of the window/door. When the water-detergent mixture is sprayed onto the top of the awning, any excess not absorbed into the awning material tends to flow downhill and toward the leak guard 308 which captures the runoff until it can be vacuumed away. In one implementation, the leak guard 308 is made of a flexible, durable material (such as rubber) and has a concave shape that faces the distal end of the cleaning head unit 300*a*. The leak guard 308 also extends slightly further than any other protuberance from the downward facing side of the cleaning head unit 300*a* to ensure that it touches the awning material when the cleaning head unit is in operation. As such, the leak guard 308 may be susceptible to wear. To ameliorate this issue, in one implementation, the leak guard is affixed to the cleaning head unit in a manner that makes it removable so that it can be replaced with a new leak guard when necessary. Just forward of the leak guard 308 is a row of rotating bristle brushes 310*a* (four in the depicted implementation). In the depicted implementation, the brushes 310*a* are circular and rotate about a central hub on a plane that is parallel to the downward-facing side of cleaning head unit 300*a*. The hubs of the brushes are driven by one or more electric motors (not shown) that are powered via an electrical line coming from the aforementioned electrical supply line connector interface 306. Forward of the rotating bristle brushes 310*a* is a row of water-detergent applicator nozzles 312 (six in the depicted implementation). The row of nozzles 312 runs laterally across the downward facing side of the cleaning head unit 300*a*. The water-detergent mixture is fed into the cleaning head unit 300*a* via the aforementioned water-detergent feed line connector 304 through tubes or channels inside the cleaning head (not shown) to each nozzle 312. When activated, the nozzles 312 spray a water-detergent mixture onto the top of the awning being cleaned. In one implementation, each of the applicator nozzles is replaceable. In addition, in one implementation, an individual nozzle can exhibits a spray angle and spray pattern that is the same as or different from any of the other applicator nozzles. At the distal end of the cleaning head unit 300*a*, just forward of the line of nozzles 312, there is an elongated extraction port 314 that run laterally across the downward facing side of the cleaning head unit. A vacuum capable of drawing and storing liquids that resides in the portable or truck-mounted cleaning system draws the used water-detergent mixture (as well as dirt and debris dislodged by the water-detergent spray) into the extraction port 314, through a channel or hose in the cleaning head (not shown), out of the extension line segment connector 302 and into the extension line. It is noted that the number of brushes, and the diameter of the brushes, can vary as desired.

Figure 3A:
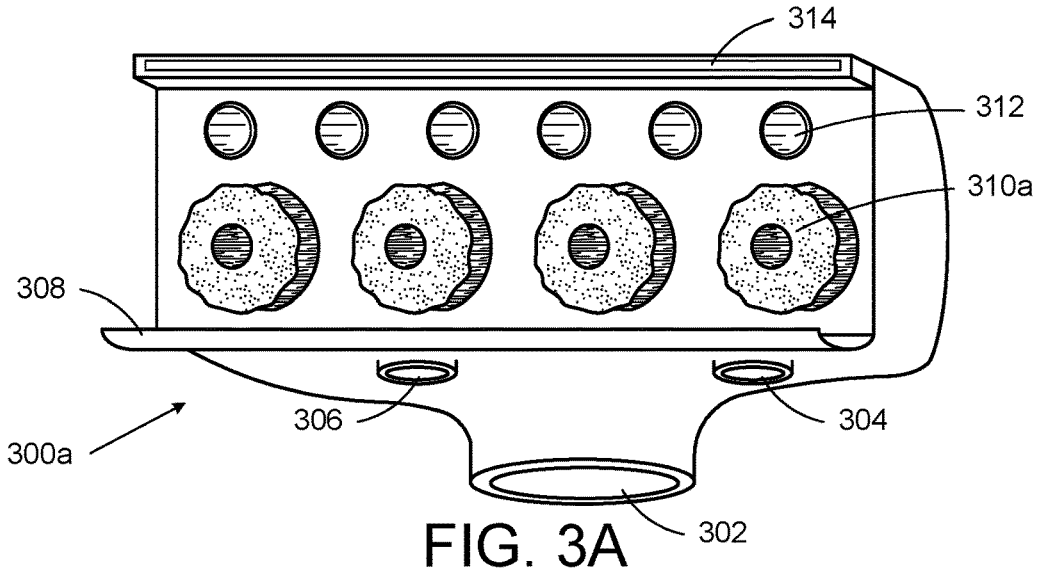
FIGS. 3A-D are schematic perspective views of various implementations of an awning cleaning tool cleaning head unit.
Figure 3B:
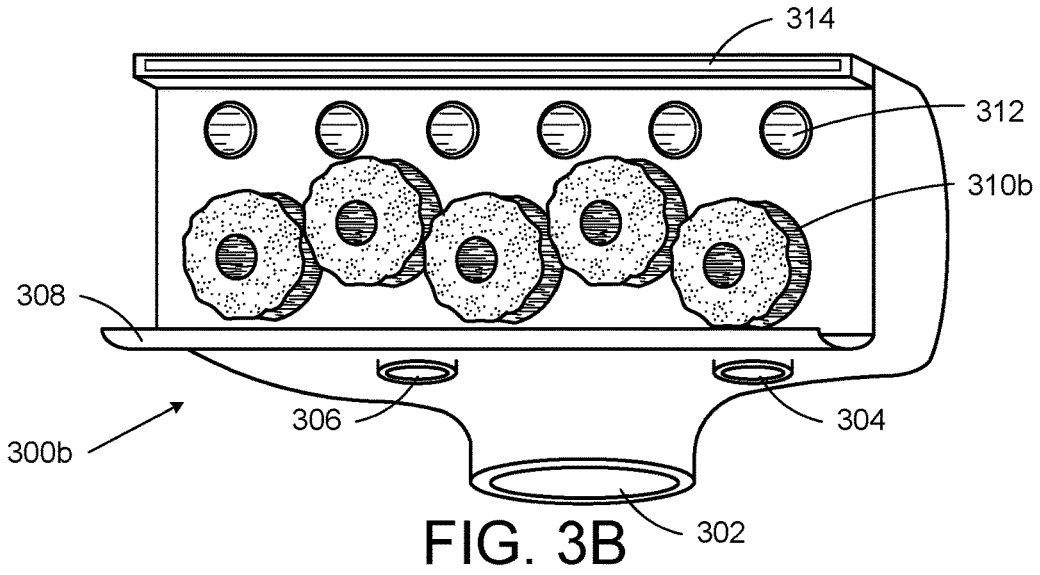

In one implementation shown in FIG. 3B, the cleaning head unit 300*b* is generally the same as the configuration shown in FIG. 3A, with the exception of the brushes. In this alternate implementation, just forward of the leak guard 308 there are two rows of circular, rotating bristle brushes 310*b* (five in the depicted implementation) where the circular brushes in each row are laterally offset from the adjacent brush in the other row. Each of these circular brushes 310*b* rotates about a different central hub on a plane that is parallel to the downward-facing side of the cleaning head unit 300*b*.

As before, each central hub is driven by an electric motor that is powered via an electrical line coming from the electrical supply line connector interface 306. The number of rows, the number of brushes, and the diameter of the brushes can vary as desired. However, the purpose of the offset design is to ensure a more complete coverage of the awning surface below the cleaning head unit.

Figure 3C:
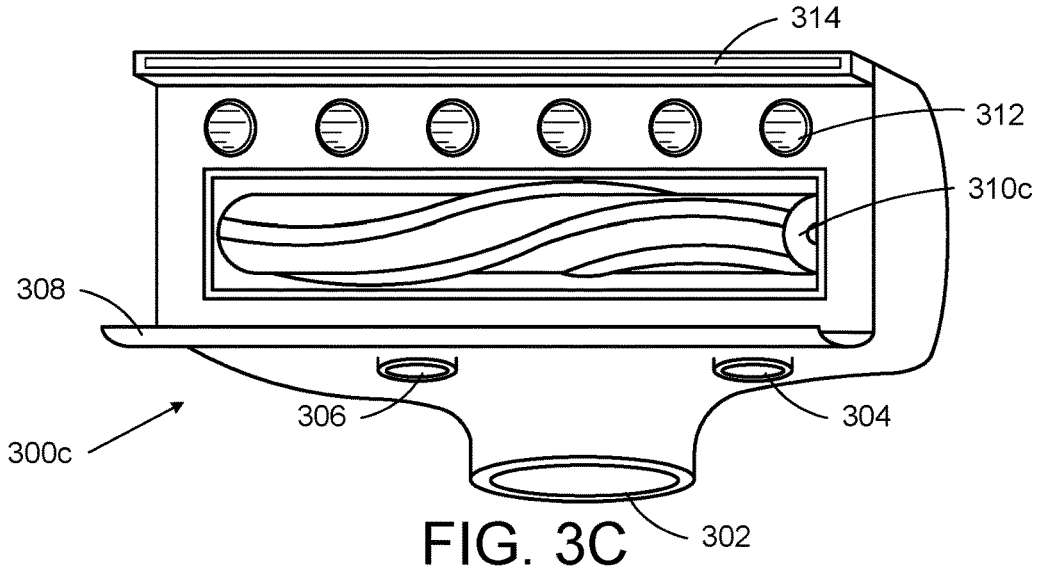

In one implementation shown in FIG. 3C, the cleaning head unit 300*c* is again generally the same as the configuration shown in FIG. 3A, with the exception of the brushes. In this alternate implementation, just forward of the leak guard 308 there is a single cylindrical brush 310*c* which rotates about central hub on a plane that is perpendicular to the downward-facing side of the cleaning head unit 300*c*. The central hub is driven by an electric motor that is powered via an electrical line coming from the electrical supply line connector interface 306.

Figure 3D:
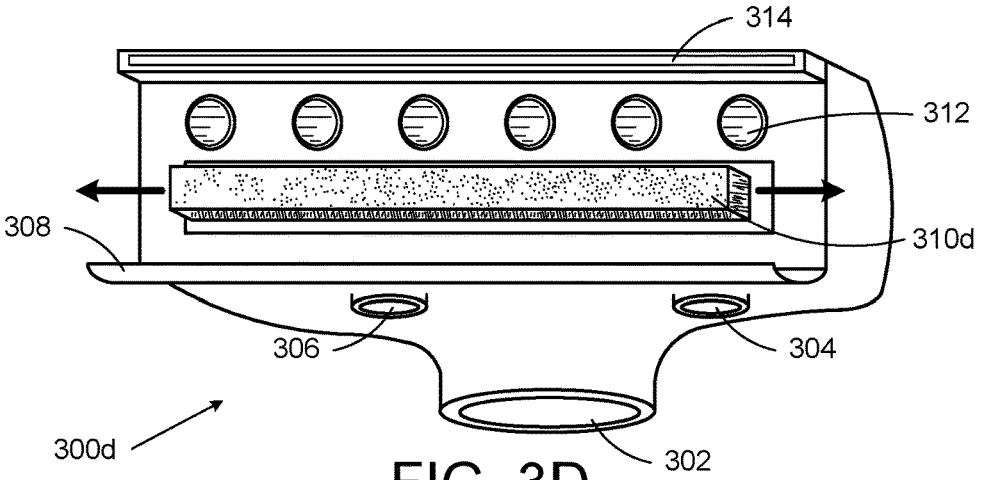

In one implementation shown in FIG. 3D, the cleaning head unit 300*d* is again generally the same as the configuration shown in FIG. 3A, with the exception of the brushes. In this alternate implementation, just forward of the leak guard 308 there is a single rectangular brush which laterally reciprocates across the downward-facing side of the cleaning head unit 300*d*. The rectangular brush 310*d* is driven by an electric motor that is powered via an electrical line coming from the electrical supply line connector interface 306.

Figure 4:
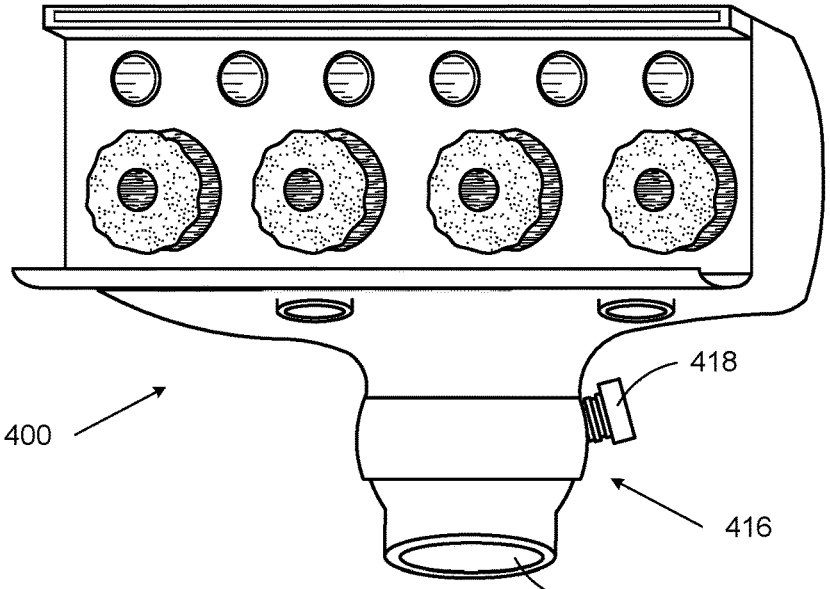
FIG. 4 is a schematic perspective view of one implementation of an awning cleaning tool cleaning head unit that includes a ball and socket joint.

In any of the foregoing cleaning head unit implementations, the cleaning head unit can include a swivel joint located between the body of the head and the extension line segment connector. Any swivel joint that allows the cleaning head unit to be positioned at an angle to the extension line segment(s) connected to it (at least in the pitch direction), and allows air and fluids to pass through, can be employed. For example, in one version, as shown in FIG. 4, the swivel joint takes the form of a ball joint 416 that allows the cleaning head unit 400 to be positioned at an angle to the longitudinal axis of the attached extension line (not shown) in pitch, yaw and roll directions up to some limit (e.g., 90 degrees). The purpose of the swivel joint is to allow a technician to angle the cleaning head unit so that it stays flat against the surface of the awning no matter what the slope of the awing or the location of the technician. In addition, in one implementation, the swivel joint is loose enough that the angle automatically changes to maintain the cleaning head unit flat against the awning as the awning cleaning tool is moved during the cleaning operation. It is noted that this latter implementation can enhance the safety of the technician since the cleaning head unit stays flat against the awning without the technician having to contort themselves in an effort to manipulate the awning cleaning tool to maintain the cleaning head unit flat against the awing. However, in some circumstances it may be advantageous to fix the swivel joint at a desired angle. To this end, in one implementation as shown in FIG. 4, a releasable lock 418 is included that when engaged retains the then existing angle between the cleaning head unit 400 and the extension line and when released allows the cleaning head unit to pivot in relation to the extension line.

Figure 5:
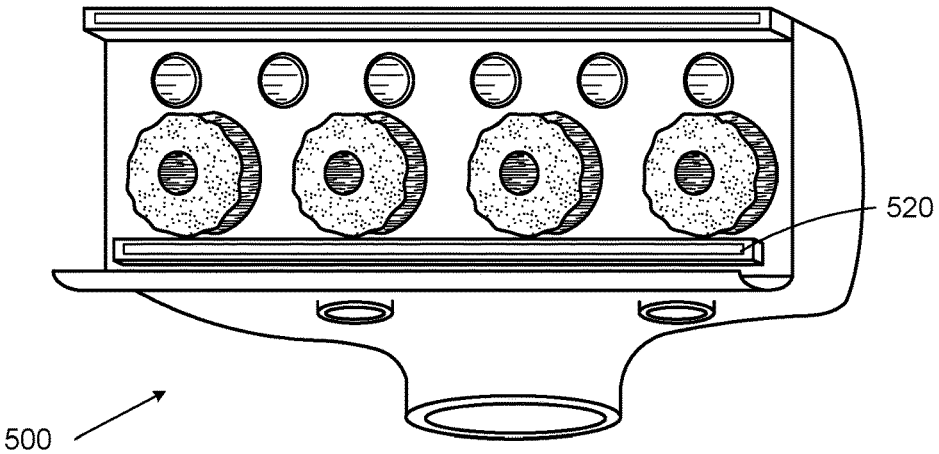
FIG. 5 is a schematic perspective view of one implementation of an awning cleaning tool cleaning head unit that includes a second extraction port.

Additionally, in any of the foregoing cleaning head unit implementations, the cleaning head unit can include a second elongated extraction port that run laterally across the downward-facing side of the cleaning head unit between the leak guard and the brushes. For example, referring to FIG. 5, the implementation of the cleaning head unit 300*a* of FIG. 3A is shown with the second elongated extraction port 520. The purpose of this second port 520 is to increase the extraction capability of the cleaning head unit 500 to ensure the used water-detergent solution is more completely removed from the awning to facilitate quick drying and more fully ensure there is no run-off.

1.1.2 Extension Line

Figure 6:
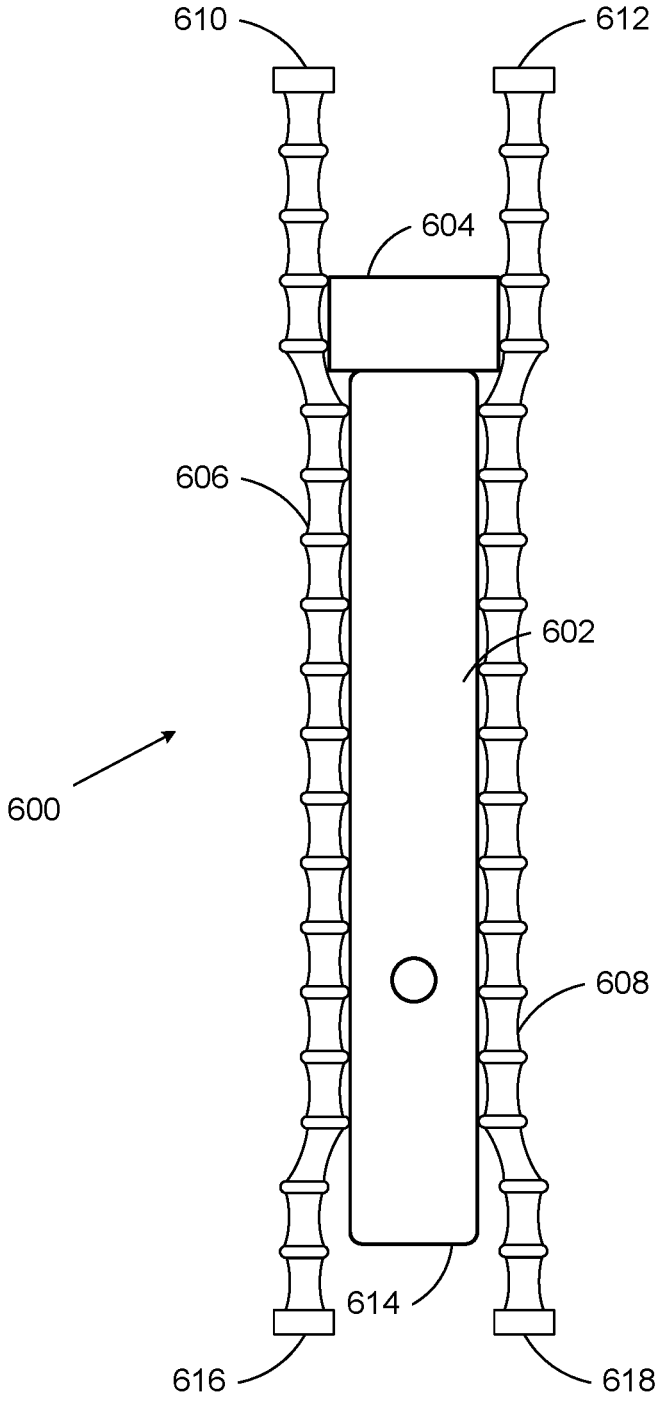
FIG. 6 is a schematic side elevation of one implementation of an awning cleaning tool extension line segment.

FIGS. 1 and 2 show a one-piece extension line configuration. However, it can be advantageous for the extension line to be variable in length so as to facilitate the cleaning of different sized awnings, and for storage and transport between cleaning sites. Referring to FIGS. 6 and 7, implementations of variable length extension lines are illustrated. FIG. 6 shows a segmented extension line configuration and FIG. 7 shows a telescoping extension line configuration.

Referring to FIG. 6, in one implementation, the extension line has two or more segments 600, one of which is depicted. Each extension line segment 600 has an elongated, hollow, tube-shaped body 602 made of a rigid material that acts as the vacuum line. The distal end of the segment has an interface connector 604 for attaching to either the extension line segment connector (e.g., 302 in FIGS. 3A-E) of the cleaning head unit, or the proximal end connector 614 of another extension line segment 600. In operation, enough of the extension line segments are assembled together end to end so as to allow an operator to safely reach the furthest extent of the awning being cleaned either from the ground or a secure raised platform or ladder. More particularly, one extension line segment is coupled to another extension line segment via distal end couplings of the one segment and proximal end couplings of the other segment. An extension line segment water-detergent feed line 606 and an extension line segment electrical supply line 608 run along the outside of the body of the extension line segment 600. In the depicted implementation, the water-detergent feed line 606 and an electrical supply line 608 are shown as ribbed tubular structures. However, it is not intended that the awning cleaning tool be limited to this ribbed structure. Rather, the water-detergent feed line can have any appropriate configuration that allows the water-detergent mixture to flow therein without leaking. As for the electrical supply line, any appropriate configuration that protects the electrical wiring from moisture and physical damage can be employed. Alternately, in an implementation not shown in the figures, the water-detergent feed line and electrical supply line could run along a protected channel or channels inside of the extension line segment. The distal ends of the extension line segment water-detergent feed line 606 and the extension line segment electrical supply line 608 have interface connectors 610, 612, respectively, that connect with the corresponding connector interfaces (e.g., 304 and 306 in FIGS. 3A-D2) of the cleaning head or the proximal end of another extension line segment. The proximal ends of the extension line segment 602, extension line segment water-detergent feed line 606 and the extension line segment electrical supply line 608 have interface connectors 614, 616, 618, respectively, that connect with the corresponding connector interface connectors 604, 610, 612 at the distal end of another extension line segment, or the corresponding interface connectors (e.g., 1002, 1004, 1006, respectively, of FIGS. 10A-B) of the control handle (which will be described shortly).

Figure 7A:
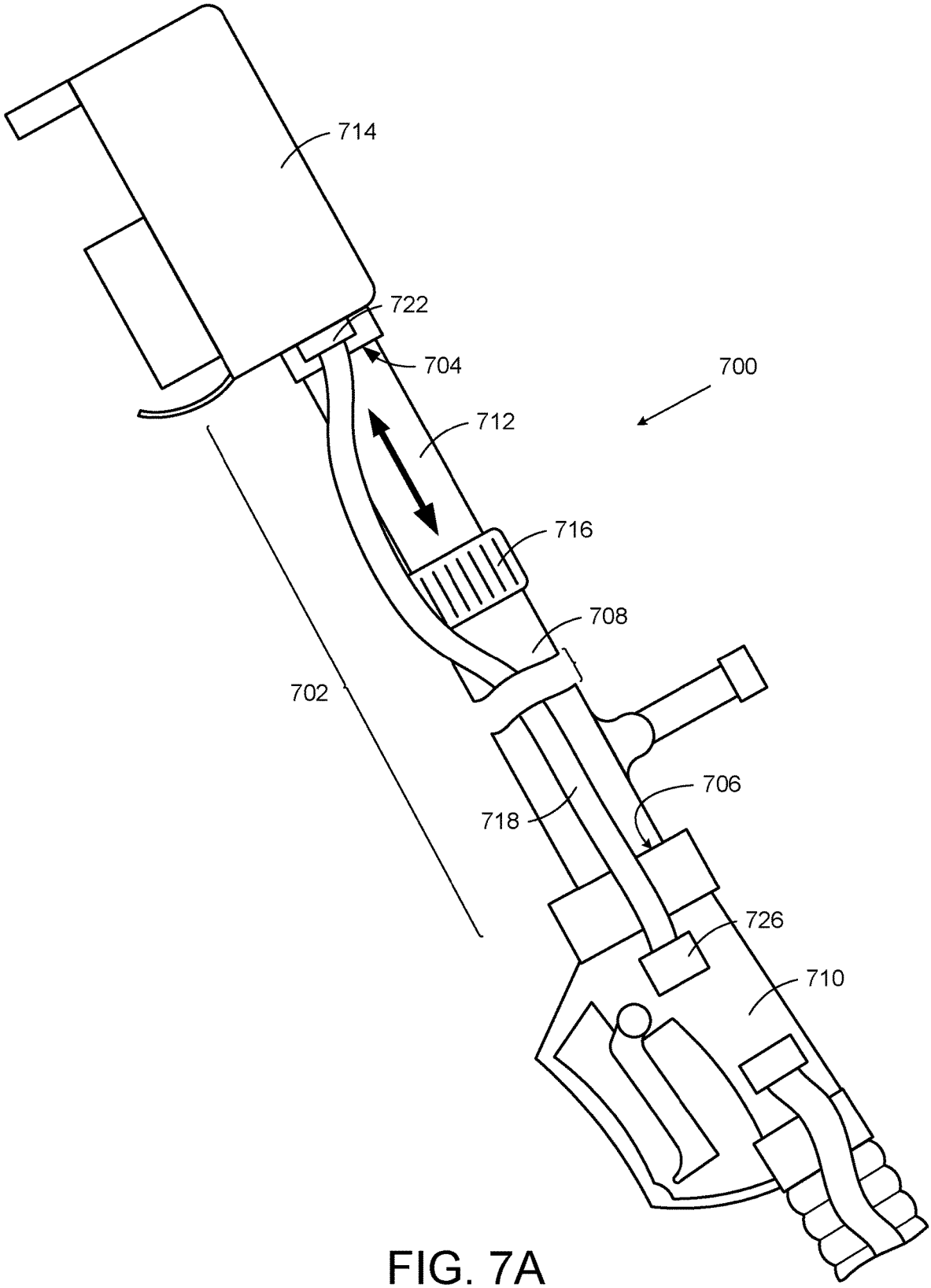
FIGS. 7A-B are schematic side elevations of opposite sides of one implementation of an awning cleaning tool having a telescoping extension line.
Figure 7B:
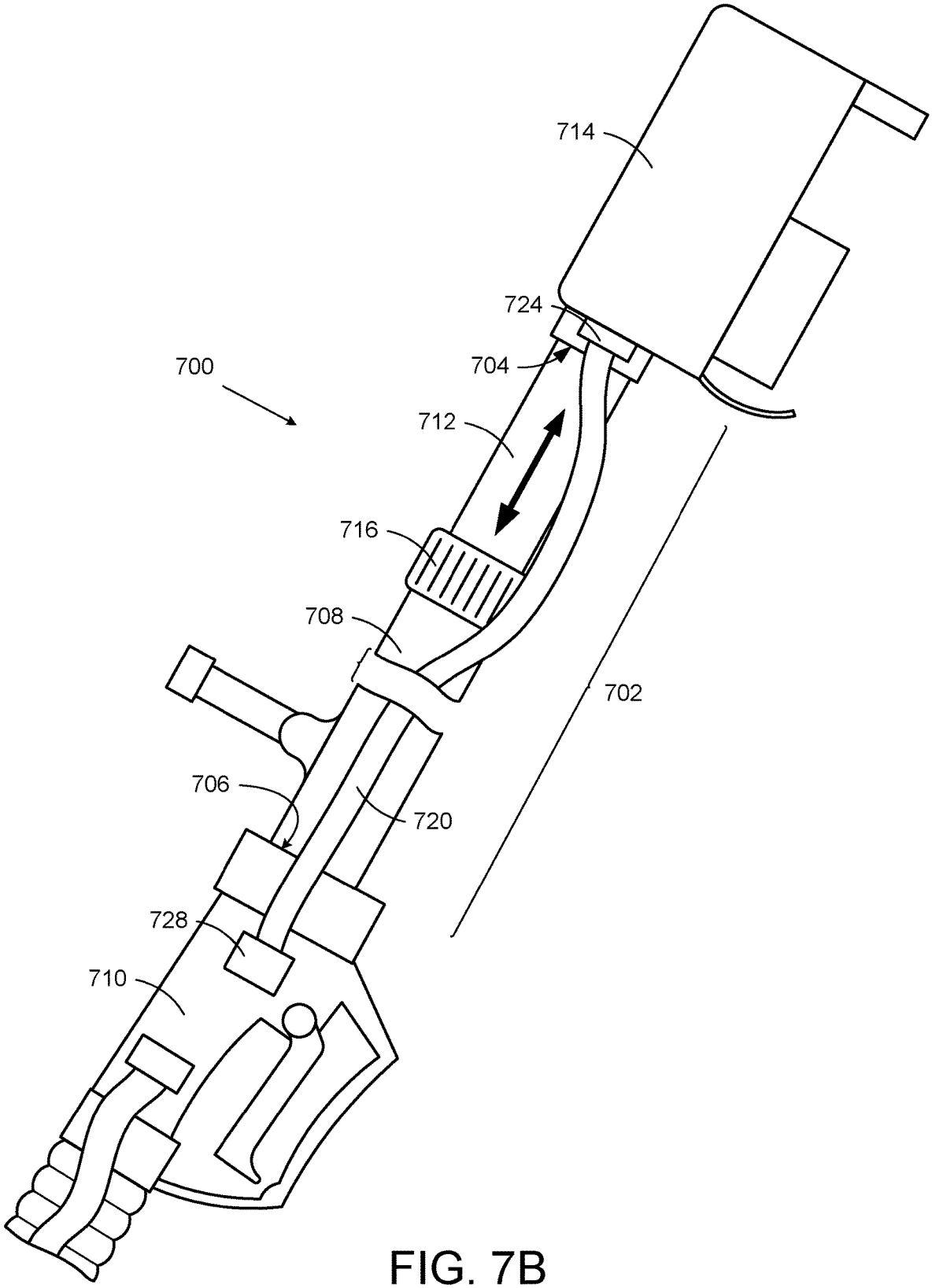

Referring to FIGS. 7A-B (which depict the extension line from one side in FIG. 7A and its other side in FIG. 7B), in one implementation, the extension line 700 includes an elongated, hollow, tube-shaped, telescoping body 702 made of a rigid material. This telescoping body 702 forms a vacuum line. The distal end of the telescoping body 702 has an interface connector 704 for attaching to the extension line connector (e.g., 302 in FIGS. 3A-E) of the cleaning head unit, and the proximal end of the telescoping body 702 has an interface connector 706 for attaching to the extension line connector (e.g., 1002 in FIGS. 10A-B) of the control handle. The telescoping body 702 has a larger diameter control handle section 708 that attaches to the control handle 710 and a smaller diameter cleaning head section 712 that attaches to the cleaning head unit 714. In one implementation, the outer diameter of the cleaning head section 712 is just slightly smaller than the inner diameter of the control handle section 708 such that the cleaning head section 712 can easily slide into and out of the control handle section 708. In the depicted implementation, there is a conventional rotating lock cam 716 at the distal end of the control handle section 708. This lock cam 716 is rotated in a first direction to cinch down on the cleaning head section 712 and prevent it from being further extended from or retracted into the control handle section 708, and rotated in the opposite direction to release the cleaning head section 712. In this way the length of the telescoping body can be easily adjusted. It is noted, however, that other locking mechanisms can also be employed to adjust and set the length of the telescoping body as desired. In operation, the telescoping extension line is extended to whatever length needed to allow an operator to safely reach the furthest extent of the awning being cleaned either from the ground or a secure raised platform or ladder, and then retracted as needed during the cleaning process.

Referring again to FIGS. 7A-B, an extension line water-detergent feed line 718 and an extension line electrical supply line 720 run along the outside of the body of the telescoping body 702. In the depicted implementation, the water-detergent feed line 718 and an electrical supply line 720 are shown as smooth tubular structures. However, it is not intended that the awning cleaning tool be limited to this structure. Rather, the water-detergent feed line can have any appropriate configuration that allows the water-detergent mixture to flow therein without leaking. As for the electrical supply line, any appropriate configuration that protects the electrical wiring from moisture and physical damage can be employed. The distal ends of the extension line water-detergent feed line 718 and the extension line electrical supply line 720 have interface connectors 722, 724, respectively, that connect with the corresponding connector interfaces (e.g., 304 and 306 in FIGS. 3A-D2) of the cleaning head unit. The proximal ends of the telescoping body 702, extension line water-detergent feed line 718 and the extension line electrical supply line 720 have interface connectors 706, 726, 728, respectively, that connect with the corresponding interface connectors (e.g., 1102, 1104, 1106, respectively, of FIGS. 11A-B) of the control handle (which will be described shortly).

Figure 8:
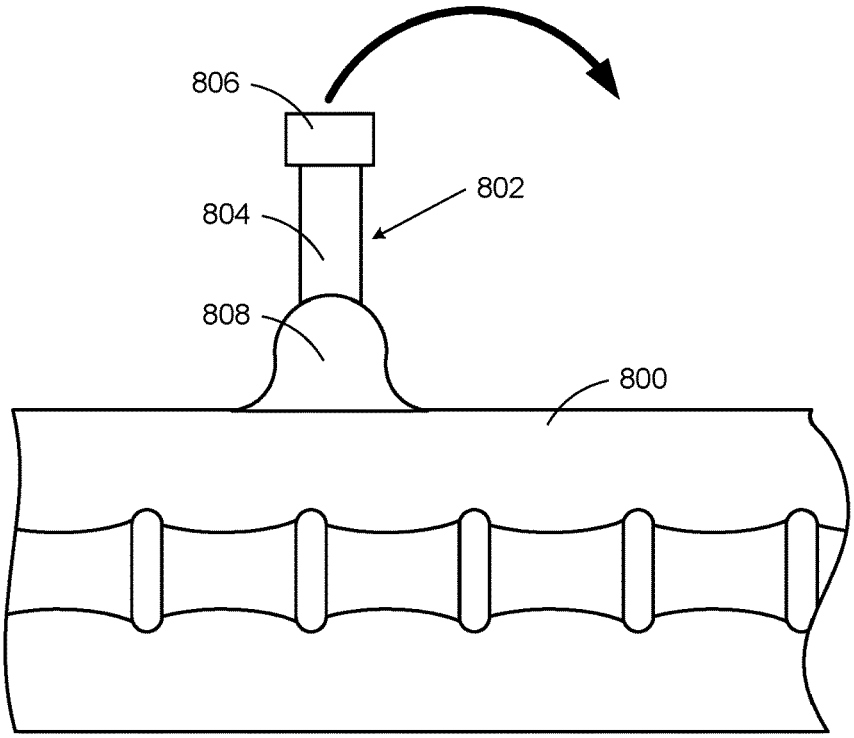
FIG. 8 is an enlarged, fragmentary, schematic side elevation, of an awning cleaning tool extension line showing one implementation of a fold-down handle in its extended position.
Figure 9:
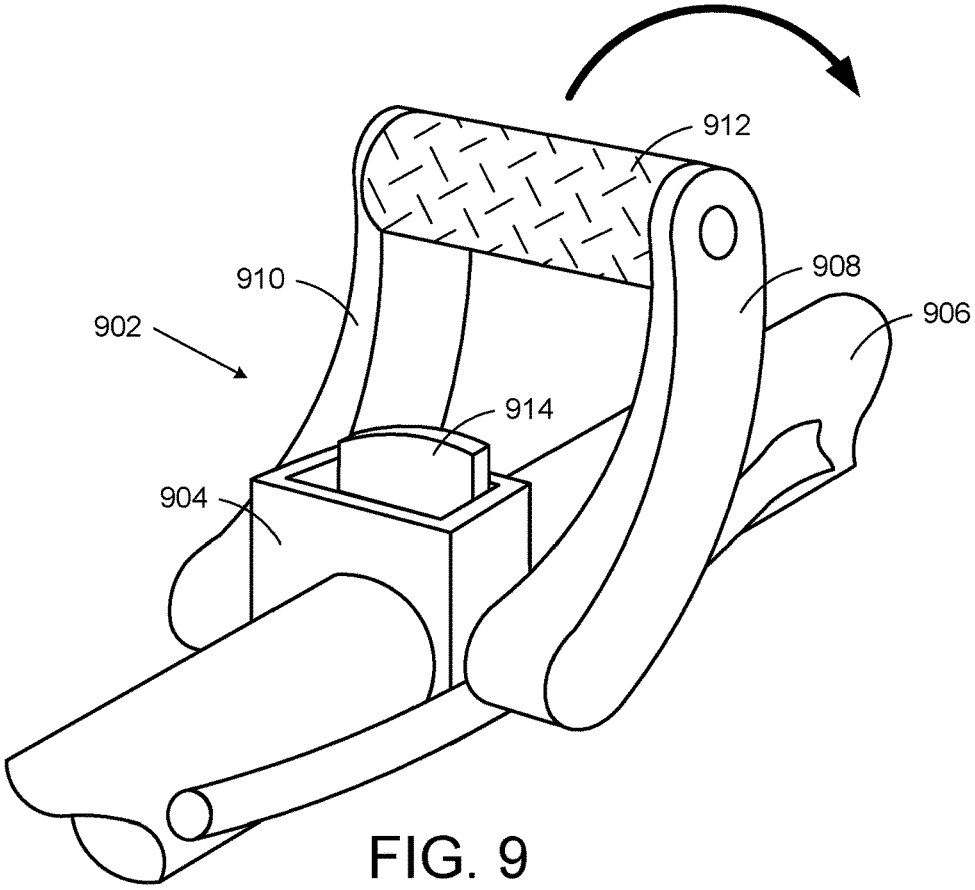
FIG. 9 is an enlarged, fragmentary, schematic side elevation, of an awning cleaning tool extension line showing another implementation of a fold-down handle in its extended position.

Referring to FIGS. 8 and 9, in various implementations the extension line 800, 900 includes a fold-down handle 802, 902 located on the extension line closer to the control handle than the cleaning head unit. The fold-down handle 802, 902 is extended so that it projects radially out from the side of the extension line 800, 900 during cleaning operations to provide a hand-hold for an operator and assist the operator in controlling the awning cleaning tool. The fold-down handle 802, 902 is retracted against the extension line 800, 900 when the awning cleaning tool is not in use for ease in storage. More particularly, referring to FIG. 8, in one implementation the fold-down handle 802 has a single bar 804 with a knob 806 at its distal end. The proximal end of the bar 804 is connected to a hinge 808 that allows the handle 802 to be extended out or retracted against the extension line 800. In one version, the fold-down handle 802 includes a conventional locking mechanism (not shown) that locks the handle into its extended and retracted positions. In the previously described segmented extension line configuration, at least the extension line segment that is attached the control handle (which will sometimes be referred to as the base extension line segment in the description to follow) has the fold-down handle 802.

Referring to FIG. 9, in one implementation the fold-down handle 902 has a central block 904 through which the extension line body 906 passes. The central block 904 is secured to the extension line body 906 using conventional attachment methods. In one version, the central block 904 is permanently attached to the extension line body 906. In another version, the central block 904 is releasable attached to the extension line body 906 so that it can be released and slid along the extension line body to the desired location and then cinched down onto the body. Two arms 908, 910 are rotatably attached to each side of the central block 904 and connected at their distal ends to a hand grip 912. The handle 902 can be extended out or retracted against the extension line 900 by rotating it in relation to the block 904. In the depicted version, the fold-down handle 902 includes a conventional locking mechanism 914 that locks the handle into its extended and retracted positions. In the previously described segmented extension line configuration, at least the extension line segment that is attached the control handle (which will sometimes be referred to as the base extension line segment in the description to follow) has the fold-down handle 902.

Generally, the fold-down handle is attached to the extension line body at a distance from the control handle that allows the operator to comfortably reach the handle and use it to maneuver the awning cleaning tool. In versions where the fold-down handle is releasably attached to the extension line, the operator can position the handle along the extension line at the place that is most comfortable for that operator.

1.1.3 Control Handle

Referring to FIGS. 10A-B and 11A-B, in various implementations the control handle 1000, 1100 has a connector interface 1002, 1102 that accepts the connector found at the distal end of the extension line (e.g., 614 in FIG. 6 or 706 in FIGS. 7A-B). In addition, there is a control handle water-detergent feed line connector interface 1004, 1104 (shown in FIGS. 10A and 11A respectively) and a control handle electrical supply line connector interface 1006, 1106 (shown in FIGS. 10B and 11B respectively) that connect to the corresponding water-detergent feed line and electrical supply line connector interfaces (e.g., 616, 618 in FIG. 6 or 726, 728 in FIGS. 7A-B) terminating at the distal end of the extension line. The implementations depicted in FIGS. 10A-B and 11A-B, differ in how the vacuum hose 1008, 1108, water-detergent feed line 1010, 1110 and an electrical supply line 1012, 1112 from an existing portable and truck-mounted cleaning system (not shown) connect to the control handle 1000, 1100. The implementations depicted in FIGS. 10A-B and 11A-B also differ in the configuration of a control switch.

Figure 10A:
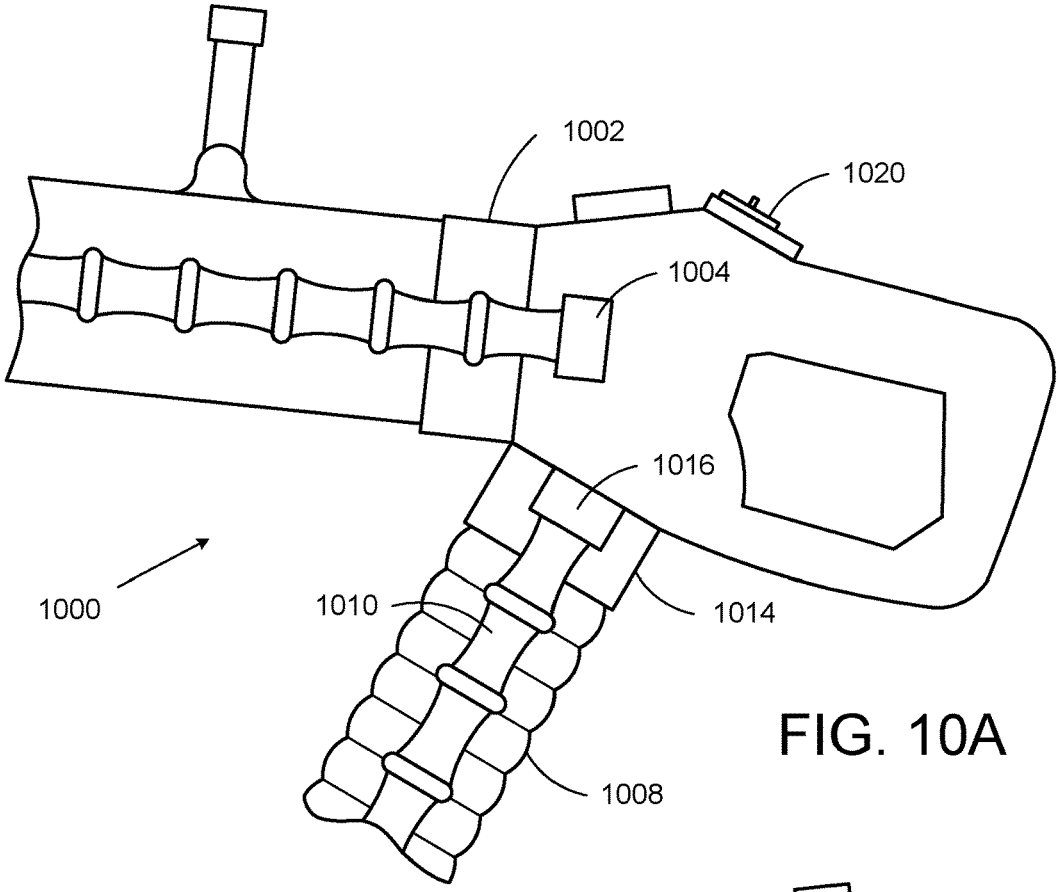
FIGS. 10A-B are schematic side elevations of opposite sides of one implementation of an awning cleaning tool control handle.
Figure 10B:
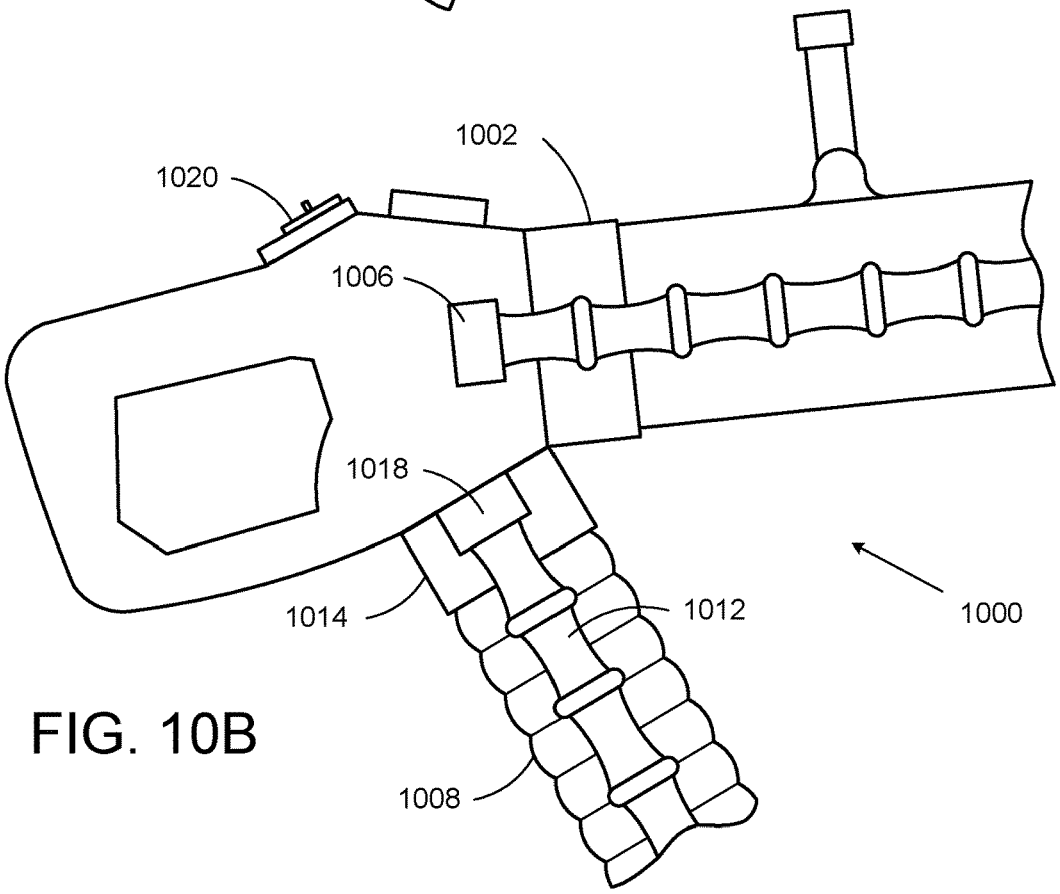

More particularly, referring to FIGS. 10A-B (which depict the control handle from one side in FIG. 10A and its other side in FIG. 10B), in one implementation, on the bottom of the control handle 1000, a vacuum hose connector interface 1014 is included for connecting to the vacuum hose 1008 from the existing portable and truck-mounted cleaning system. Similarly, there are connection interfaces 1016, 1018 that respectively attach to a water-detergent feed line 1010 and an electrical supply line 1012 coming from the existing portable and truck-mounted cleaning system. In one version as depicted in FIGS. 10A-B, the connector interfaces 1016, 1018 of the control handle 1000 for the water-detergent feed line and the electrical supply lines, respectively, are located on either side of the handle. However, it is not intended that the awning cleaning tool be limited to this configuration. The connector interfaces of the control handle can be located anywhere that is convenient to the internal configuration of the handle. For example, in one implementation the connector interfaces of the control handle are located on the top of the handle just in front of a control switch.

The control handle is used to switch between modes of operation. More particularly, in one implementation shown in FIGS. 10A-B, the control handle 1000 has a control switch 1020 where a person's thumb would rest when gripping the control handle through its hand grip opening 1022. This allows the technician to quickly switch between modes. For example, in one version, when the switch 1020 is slid in a first direction (which in one version is toward the front of the control handle) it activates a cleaning mode. In this mode, the vacuum is disabled, and the water-detergent feed and electrical supply lines are activated. When the switch 1020 is slid in the other direction, an extraction mode is initiated. In the extraction mode, the vacuum is enabled, and the water-detergent feed and electrical supply lines are deactivated. In another version, it is recognized that agitating with the brushes during the extraction mode can assist in the removal of the used water-detergent mixture. In this version, when the switch 1020 is slid in a first direction the vacuum is disabled, and the water-detergent feed and electrical supply lines are activated. When the switch 1020 is slid in the other direction, the extraction mode is initiated. In the extraction mode, the vacuum and electrical supply lines are activated, and the water-detergent feed is deactivated. It is further noted that in either of the foregoing versions, the control switch can include a third position that activates a neutral mode. For example, when the sliding switch 1020 is in the middle of its slide track it would be in this third position that activates the neutral mode of operation. In the neutral mode, the vacuum line, water-detergent feed and electrical supply line are all off. In yet another version, it is recognized that the water-detergent mixture can be sprayed onto the awning surface being cleaned, agitated with the previously described brush or brushes, and extracted all at the same time. In this version, when the switch 1020 is slid in a first direction (which in one version is toward the front of the control handle) the vacuum, water-detergent feed and electrical supply lines are all activated. When the switch 1020 is slid in the other direction, the neutral mode is initiated. In the neutral mode, the vacuum, water-detergent feed and electrical supply lines are all deactivated.

It is further noted that while a sliding switch 1020 is shown in FIGS. 10A-B, it is not intended to limit the awning cleaning tool to such a switch. Rather other switch configurations can be employed, for example, but not limited to, a toggle-type switch, a security switch (such as used on a power table saw), a multiple-button switch, a gas-pump style lever switch (as depicted in the control handle implementation shown in FIGS. 11A-B as will be described shortly), and so on. In general, any switch that can be operated by the technician with the same hand that is also holding the control handle would be an appropriate choice.

Figure 11A:
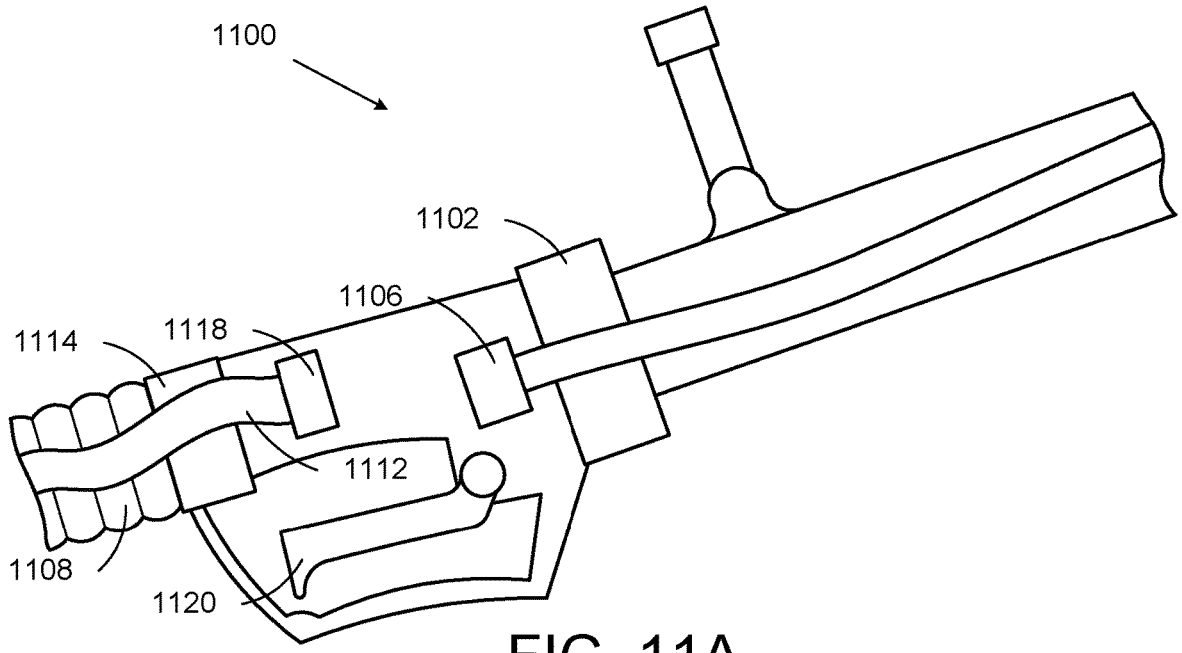
FIGS. 11A-B are schematic side elevations of opposite sides of another implementation of an awning cleaning tool control handle.
Figure 11B:
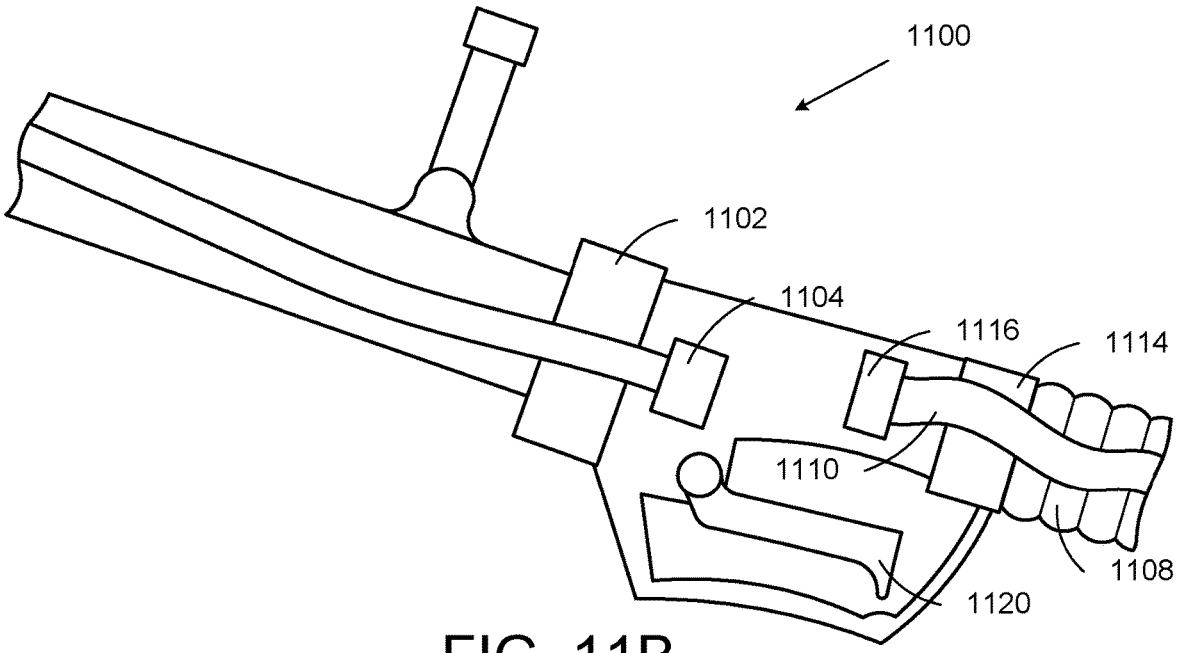

Referring to FIGS. 11A-B (which depict the control handle from one side in FIG. 11A and its other side in FIG. 11B), in one implementation, the vacuum hose connector interface 1114 is included for connecting to the vacuum hose 1108 from the existing portable and truck-mounted cleaning system to the back of the control handle 1100. Similarly, there are connection interfaces 1116, 1118 that respectively attach to a water-detergent feed line 1110 and an electrical supply line 1112 coming from the existing portable and truck-mounted cleaning system to the control handle 1100. In one version as depicted in FIGS. 11A-B, the connector interfaces 1116, 1118 of the control handle 1100 for the water-detergent feed line and the electrical supply lines, respectively, are located on either side of the back of the handle. However, it is not intended that the awning cleaning tool be limited to this configuration. The connector interfaces of the control handle can be located anywhere that is convenient to the internal configuration of the handle.

In the implementation shown in FIGS. 11A-B, the control handle has a control switch in the form of a gas-pump style lever 1120. The gas-pump style lever 1120 is operated by squeezing the lever portion while gripping the control handle through its hand grip opening 1122. This allows the technician to quickly switch between modes. For example, in one version, when the lever 1120 is pulled upward it activates the cleaning mode. In this mode, the vacuum is disabled, and the water-detergent feed and electrical supply lines are activated. When the lever 1120 is released it springs back down and the extraction mode is initiated. In the extraction mode, the vacuum is enabled, and the water-detergent feed and electrical supply lines are deactivated. In another version, when the lever 1120 is pulled upward the vacuum is disabled, and the water-detergent feed and electrical supply lines are activated. When the lever 1120 is released, the vacuum and electrical supply lines are activated, and the water-detergent feed is deactivated. It is further noted that in either of the foregoing versions, the control switch can include a third position that activates a neutral mode. For example, the lever could be pulled downward to place it in the third position. As before, in the neutral mode, the vacuum line, water-detergent feed and electrical supply line are all off. In yet another version, when the lever 1120 is pulled upward, the vacuum, water-detergent feed and electrical supply lines are all activated. When the lever 1120 is released, the neutral mode is initiated.

In the foregoing implementations, the activations and deactivations are accomplished inside the control handle using appropriate valves and electrical switches (not shown), and control circuitry (not shown) to open or close the vacuum line and water-detergent feed, and turn the electrical supply line on and off, based on the control switch position. In another implementation, the foregoing activations and deactivations are accomplished using the existing portable or truck-mounted cleaning system controls and a signal from the control handle switch. In one version, the signal is sent via the electrical supply line. In another version, the signal is sent using a separate control switch wire (not shown). In yet another version, the signal is sent to the existing portable or truck-mounted cleaning system controls from the control handle via a wireless communication link. This wireless link is accomplished using conventional wireless communication devices contained within the control handle and in the existing portable or truck-mounted cleaning system controls.

1.2 Awning Cleaning Tool with Separate Support Structure and Vacuum Line

As described previously, in an alternate implementation of the awning cleaning tool, the support and vacuum functions are split such that the tool has a support structure that is separate from the vacuum line. This configuration can be advantageous because making the extension line described previously function as a vacuum line requires a substantially air and liquid tight construction which can add to the cost of the awning cleaning tool. However, by splitting the support and vacuum functions, a conventional air and liquid tight vacuum line can be employed. In addition, a conventional telescoping support extension or pole can be employed in a support structure for the awning cleaning tool without the need to make it air and liquid tight. Use of these conventional components can reduce the cost of the tool. This alternate implementation will now be described in more detail.

In general, the water-detergent feed line and associated connectors, electrical supply line and associated connectors, cleaning head units, and control handles described in connection with the various awning cleaning tool implementation discussed so far can be employed in a tool implementation having a support structure that is separate from the vacuum line. As such the details of these components will not be repeated here. Rather, this description will focus on the support structure and vacuum line.

1.2.1 Vacuum Line

Figure 12:
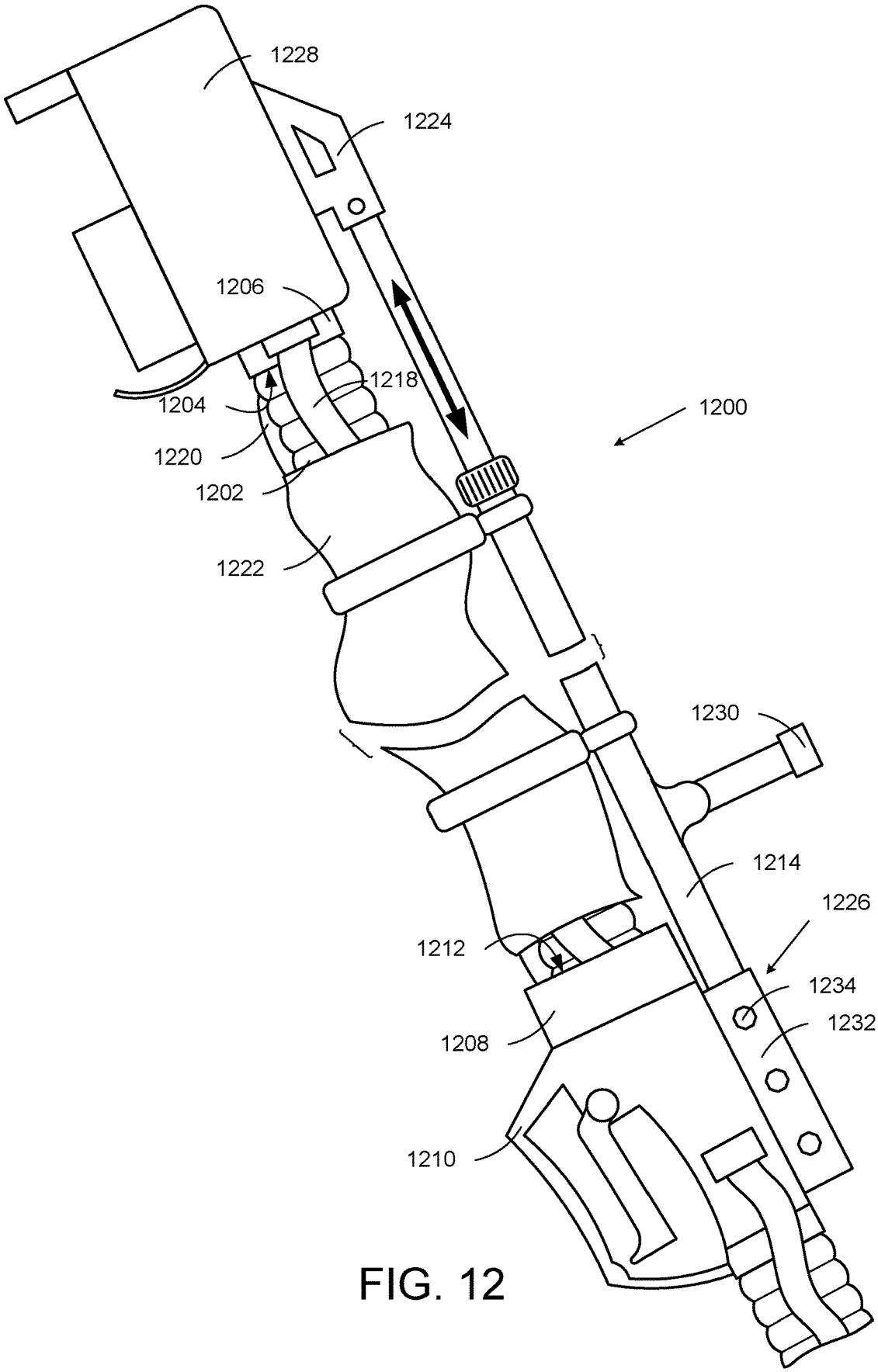
FIG. 12 is a schematic side elevation of one implementation of an awning cleaning tool having a separate support structure and vacuum line.

As indicated previously, in one implementation a conventional vacuum line such as the type employed in existing portable or truck-mounted cleaning systems, is used as a cleaning tool vacuum line 1202 for the awning cleaning tool 1200 implementation shown in FIG. 12. The cleaning tool vacuum line 1202 is coupled at a first end to the previously described vacuum connector interface 1204 (e.g., 302 of FIGS. 3A-D) of the cleaning head unit via a cleaning tool vacuum line coupling 1206. Additionally, the cleaning tool vacuum line 1202 is coupled at a second end to the previously described vacuum line connector interface 1208 (e.g., 1102 of FIGS. 11A-B) of the control handle 1210 via a second cleaning tool vacuum line coupling 1212.

Figure 13:
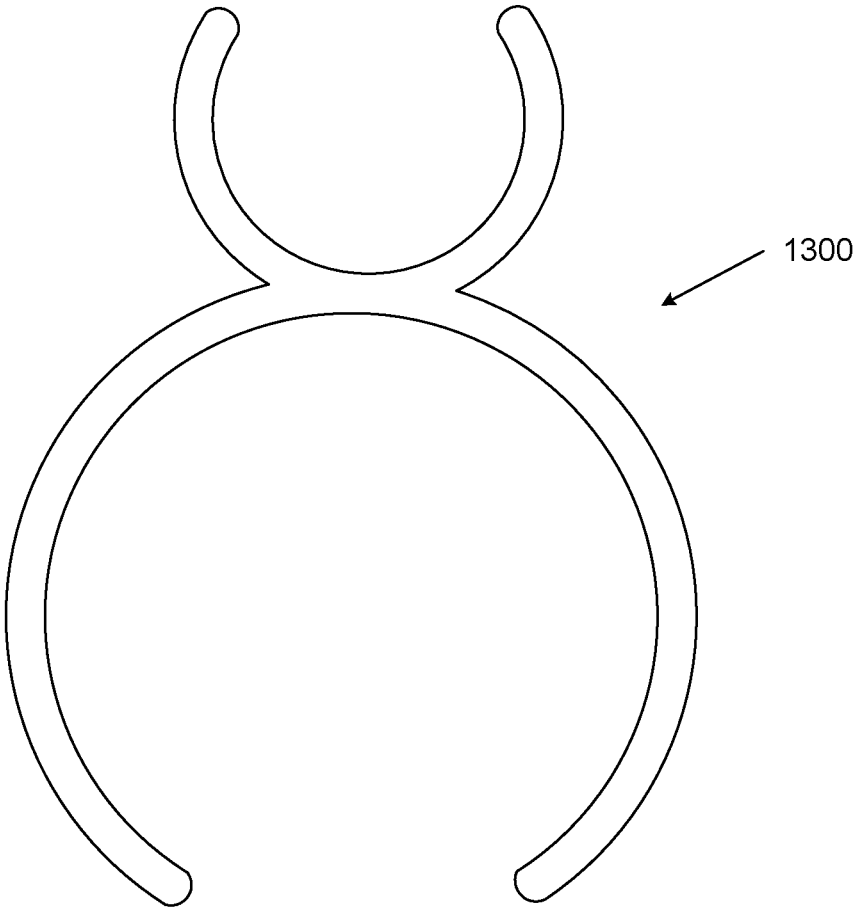
FIG. 13 is a schematic side elevation of one implementation of a clip used to secure the vacuum, water-detergent and electrical supply lines to the support extension.

Typically, a vacuum line 1202 of the type employed in the awning cleaning tool implementation shown in FIG. 12 is flexible and so needs to be supported along its length to minimize the pulling forces placed on the aforementioned vacuum line couplings by the weight of the vacuum line, and to keep the vacuum line from sagging excessively during the cleaning operation. To this end, in one implementation, the vacuum line 1202 is tethered to a support extension 1214 using one or more clips 1216 (two of which are shown in FIG. 12). FIG. 13 illustrate one version of a clip 1300 that can be employed. In addition, referring again to FIG. 12, since the vacuum line 1202, water-detergent feed line 1218 and electrical supply line 1220 are all flexible and exposed, in one implementation a protective sleeve 1222 is employed to keep the lines together and to assist in protecting them from damage. For example, one version of the sleeve 1222 is a flexible, braided, nylon mesh tube.

1.2.2 Support Structure

Referring again to FIG. 12, the aforementioned support structure includes a telescoping support extension 1214, a cleaning head unit attachment 1224 and a control handle attachment 1226. In one implementation, the telescoping support extension 1214 has an elongated, tube-shaped, telescoping body made of a rigid material. The distal end of the telescoping support extension 1214 interfaces with a cleaning head unit attachment 1224 to connect the extension to the cleaning head unit 1228. The proximal end of the telescoping support extension 1214 interfaces with a control handle attachment 1226 to connect the extension to the control handle 1210. It is noted that the cleaning head unit 1228 can be any of the implementations described previously, and the control handle 1210 can be any of the implementations described previously even though the control handle implementation of FIGS. 11A-B is shown. Additionally, the support extension includes a fold-down handle 1230. The depicted fold-down handle is the single bar implementation of FIG. 8. However, any fold-down handle implementation (e.g., the fold-down handle implementation of FIG. 9) can be employed instead. Further, in the implementation depicted in FIG. 12, there is a conventional rotating lock cam at the distal end of a control handle section of the extension. This lock cam is rotated in a first direction to cinch down on the cleaning head section of the extension and prevent it from being further extended from or retracted into the control handle section of the extension, and rotated in the opposite direction to release the cleaning head section of the extension. In this way the length of the telescoping support extension can be easily adjusted. It is noted, however, that other locking mechanisms can also be employed to adjust and set the length of the telescoping support extension as desired. In operation, the telescoping support extension is extended to whatever length needed to allow an operator to safely reach the furthest extent of the awning being cleaned either from the ground or a secure raised platform or ladder, and then retracted as needed during the cleaning process.

In the awning cleaning tool 1220 implementation depicted in FIG. 12, the cleaning head unit attachment 1224 is a non-rotating bracket that interfaces with the telescoping support extension 1214 and is attached to the upward-facing side of the cleaning head unit 1228. The upward facing side of the cleaning head unit 1228 is the side that faces away from the awning surface that is being cleaned. The cleaning head unit attachment 1224 is attached to the cleaning head unit 1228 either permanently or removably using convention methods. In the depicted version, the interface between the telescoping support extension 1214 and the cleaning head unit attachment 1224 is releasable and takes the form of a hollow sleeve on the attachment into which the distal end of the extension is inserted. A spring pin near the end of the extension is depressed during insertion and springs up into a hole in the hollow sleeve of the attachment to lock the two parts together. To release the extension, the pin is depressed, and the extension is pulled out of the hollow sleeve. However, other interfacing schemes can be employed as desired.

Figure 14:
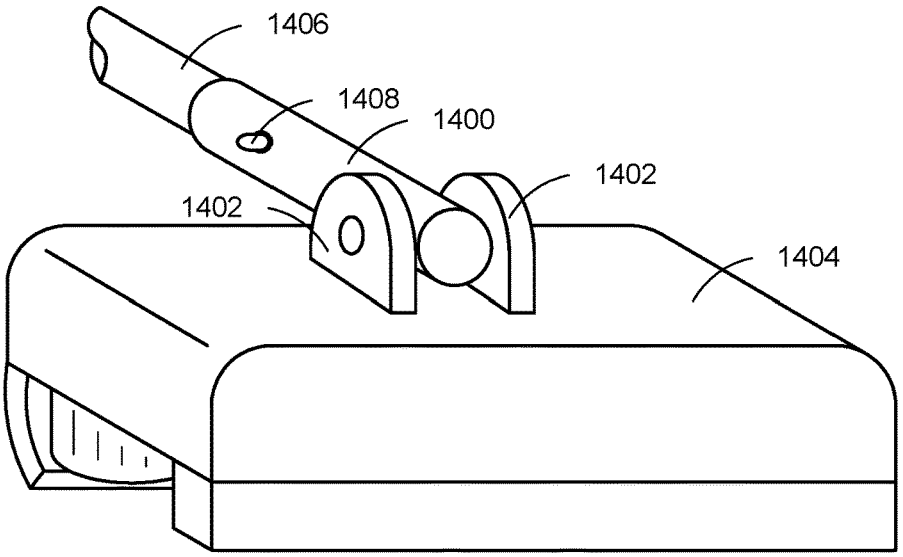
FIG. 14 is a schematic perspective view of one implementation of a cleaning head unit attachment having a hollow tubular sleeve attached between two tabs so as to form a hinged connection that allows the sleeve to rotate in relation to the cleaning head unit in the pitch direction.

Alternately, the cleaning head unit attachment can take other forms. For example, as shown in FIG. 14, in one implementation, a hollow tubular sleeve 1400 is attached between two tabs 1402 that extend away from the upward-facing side of the cleaning head unit 1404 so as to form a hinged connection that allows the sleeve to rotate in the pitch direction. The sleeve 1400 has an interior diameter that is slightly larger than the outer diameter of the distal end of the telescoping support extension 1406. The distal end of the telescoping support extension 1406 is inserted into the sleeve 1400. A spring pin 1408 near the distal end of the extension 1406 is depressed during insertion and springs up into a hole in the hollow sleeve 1400 to lock the two parts together. To release the extension 1406 from the cleaning head unit 1404, the pin 1408 is depressed, and the extension is pulled out of the hollow sleeve 1400. Again, other interfacing schemes can be employed as desired.

Figure 15:
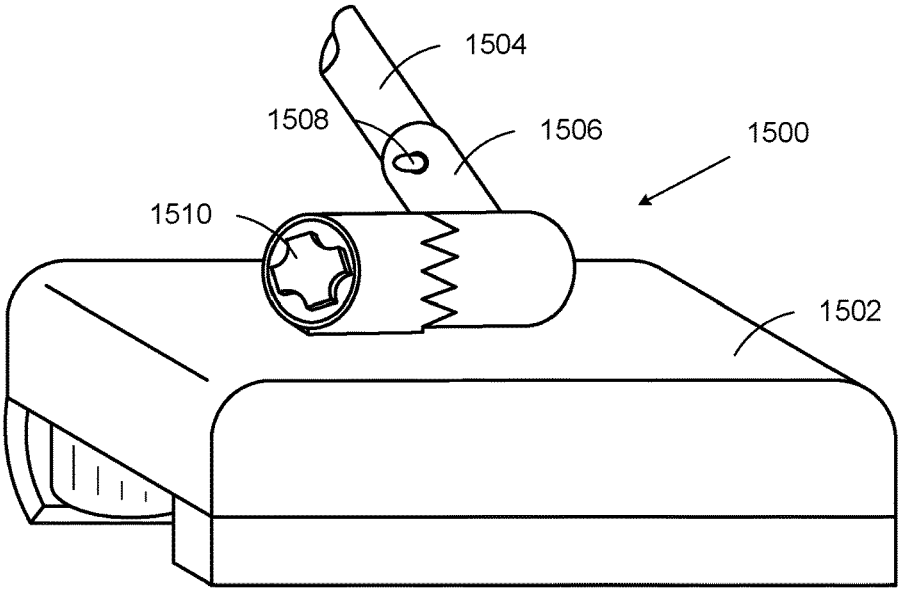
FIG. 15 is a schematic perspective view of one implementation of a cleaning head unit attachment having a locking, serrated plate-type hinge joint that allows the cleaning head unit to pivot in relation to the telescoping support extension in the pitch direction.

Referring to FIG. 15, in one implementation the cleaning head unit attachment takes the form of a locking hinge joint 1500 that allows the cleaning head unit 1502 to pivot in relation to the telescoping support extension 1504 in the pitch direction. In the depicted implementation, the locking hinge joint 1500 is a serrated plate-type hinge. One side of the hinge is not attached to the cleaning head unit 1502 and has a sleeve 1506 with an interior diameter that is slightly larger than the outer diameter of the distal end of the telescoping support extension 1504. The distal end of the telescoping support extension 1504 is inserted into the sleeve 1506. A spring pin 1508 near the distal end of the extension 1504 is depressed during insertion and springs up into a hole in the hollow sleeve 1506 to lock the two parts together. To release the extension 1504 from the cleaning head unit 1502, the pin 1508 is depressed, and the extension is pulled out of the hollow sleeve 1506. It is noted, however, that other interfacing schemes can be employed as desired. The other side of the hinge is attached to the upward-facing side of the cleaning head unit 1502 and has a screw lock 1510. To operate the hinge 1500, the screw lock 1510 is unscrewed until the teeth in one of the serrated plates clears the teeth in the other plate. The side of the hinge having the sleeve 1506 (and attached extension 1504) can then be rotated to a desired angle in relation to the upward-facing side of the cleaning head unit 1502. The screw lock 1510 is then screwed back in until the teeth in the serrated plates mesh together, thereby locking the extension 1504 at the desired angle.

Figure 16:
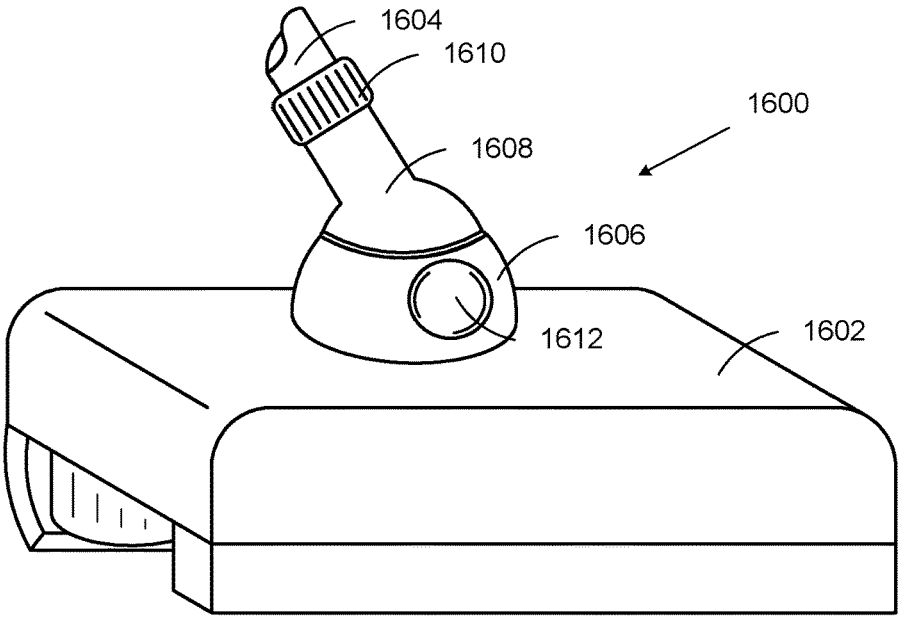
FIG. 16 is a schematic perspective view of one implementation of a cleaning head unit attachment having a locking ball and socket-type joint that allows the cleaning head unit to pivot in relation to the telescoping support extension in at least one of the pitch, roll and yaw directions.

Referring to FIG. 16, in one implementation the cleaning head unit attachment takes the form of a swivel joint 1600 that allows the cleaning head unit 1602 to pivot in relation to the telescoping support extension 1604 in at least one of the pitch, roll and yaw directions. In the depicted implementation, the swivel joint is a ball and socket-type joint with the socket portion 1606 of the joint attached to the upward-facing side of the cleaning head unit 1602. The ball portion 1608 of the joint has a hollow, cylindrical sleeve that extends out away from the upward-facing side of the cleaning head unit 1602. The sleeve has an inner diameter that is slightly larger than the distal end of the telescoping support extension 1604. There is also a conventional rotating lock cam 1610 at the distal end of the sleeve on the ball portion 1608 of the joint. In operation, the distal end of the telescoping support extension 1604 is inserted into the sleeve of the ball portion 1608. The lock cam 1610 is then rotated in a first direction to cinch down on the support extension 1604 and hold the extension it in place within the sleeve. The lock cam 1610 is rotated in the opposite direction to release the extension 1604. The depicted implementation of the swivel joint 1600 also has an optional lock 1612. This lock 1612 has a conventional push button design where a button is depressed to allow the ball portion 1608 of the joint to rotate freely within the socket portion 1606 of the joint. The ball portion 1608 of the joint (and the attached extension 1604) are rotated to form a desired angle with the upward-facing side of the cleaning head unit 1602, and then the button is released to lock the extension 1604 at the desired angle.

It is noted that the spring pin attachment scheme for releasable attaching the telescoping support extension to the cleaning head unit attachment could be employed in the swivel joint implementation described above, rather than the rotating lock cam attachment scheme. Similarly, the rotating lock cam attachment scheme could be employed in the other cleaning head unit attachment implementations rather than the spring pin attachment scheme. In general, any releasable attachment scheme can be employed to attach the telescoping support extension to the cleaning head unit attachment.

Referring again to the awning cleaning tool implementation of FIG. 12, as indicated previously, the proximal end of the telescoping support extension 1214 interfaces with a control handle attachment 1226 to connect the extension to the control handle 1210. In one version, the control handle attachment 1226 takes the form of a hollow tube 1232 that is permanently attached to the top of the control handle. The inner diameter of the tube 1232 is slightly larger than the outer diameter of the proximal end of the telescoping support extension 1214. As such the proximal end of the telescoping support extension 1214 can be inserted into the tube 1232 and releasable secured therein. In the depicted version, the proximal end of the telescoping support extension 1214 is secured with three bolts 1234. However, any method of releasable securing the proximal end of the telescoping support extension 1214 into the tube 1232 can be employed instead.

1.3 Operation

In operation, a technician first assembles the awning cleaning tool. In the case of segmented extension line implementation, the technician assembles enough extension line segments to safely reach to the furthest part of the awning being cleaned. More particularly, the technician connects a base extension line segment to the control handle via the mating vacuum line, water-detergent feed line and electrical supply line connector interfaces. The base extension line segment has the aforementioned fold-down handle. Additional extension line segments are installed onto the base segment as needed by connecting the mating vacuum line, water-detergent feed line and electrical supply line connector interfaces as described previously. In one version, each extension line segment has a length of about 4 feet. Thus, if the cleaning head unit can reach the top of the awning from the technician's position in front of the awning (e.g., on a ladder, or platform, or standing on the ground) with a single extension line segment, then only the base segment is installed on the control handle. Otherwise, additional extension line segments are employed. Once a sufficient number of extension line segments are assembled, the cleaning head unit is installed onto the distal-most end of the last segment via the mating vacuum line, water-detergent feed line and electrical supply line connector interfaces described previously. It is noted that the foregoing is just an exemplary method of assembling the awning cleaning tool with extension line segments at the site of a cleaning job. Other assembly methods can be employed as desired. For example, the cleaning head unit can be installed onto an extension line segment before attaching the control handle; or if multiple extension line segments are required, they can be connected together before installing either the control handle or the cleaning head unit.

In the case of the telescoping extension line implementations, the technician first connects the proximal end of the extension line to the control handle via the mating vacuum line, water-detergent feed line and electrical supply line connector interfaces. The cleaning head unit is then installed onto the distal end of the extension line via the mating vacuum line, water-detergent feed line and electrical supply line connector interfaces described previously. The technician next extends or retracts the extension line by loosening the rotating cam lock and sliding the cleaning head section of the telescoping extension line until the cleaning head unit can reach the top of the awning from the technician's position in front of the awning (e.g., on a ladder, or platform, or standing on the ground). The rotating cam lock is then tightened. It is noted that the foregoing is just an exemplary method of assembling the awning cleaning tool with a telescoping extension line at the site of a cleaning job. Other assembly methods can be employed as desired. For example, the cleaning head unit can be installed onto the distal end of the extension before attaching the control handle.

In the case of the awning cleaning tool implementations with a separate telescoping support extension and vacuum line, the technician connects first the proximal end of the vacuum line, water-detergent feed line and electrical supply line to the control handle via the mating vacuum line, water-detergent feed line and electrical supply line connector interfaces. The cleaning head unit is then installed onto the distal end of the vacuum line, water-detergent feed line and electrical supply line via the mating vacuum line, water-detergent feed line and electrical supply line connector interfaces described previously. The technician next attached the proximal end of the telescoping support extension to the control handle, and then attaches the distal end of the telescoping support extension to the cleaning head (or vice versa). The telescoping support extension is then extended or retracted by loosening the rotating cam lock and sliding the cleaning head section of the telescoping support extension until the cleaning head unit can reach the top of the awning from the technician's position in front of the awning (e.g., on a ladder, or platform, or standing on the ground). The rotating cam lock is then tightened. It is noted that the foregoing is just an exemplary method of assembling the awning cleaning tool with a telescoping extension line at the site of a cleaning job. Other assembly methods can be employed as desired. For example, the cleaning head unit can be installed onto the distal end of the vacuum line, water-detergent feed line and electrical supply line before attaching the control handle to the proximal end of the lines.

In all the foregoing implementation, the technician connects the vacuum hose, water-detergent feed line and electrical supply line from the existing portable and truck-mounted cleaning system to the previously-described connectors on the control handle to complete the awning cleaning tool assembly. It is noted that the technician may also perform some preliminary tasks such as setting up a ladder or platform in front of the awning to be cleaned; or spraying the awning with a pre-cleaning fluid using a conventional pump sprayer. The pre-cleaning fluid is sometimes used to loosen the dirt built up on the awning to make the cleaning process quicker and more complete.

Once the preliminary tasks are complete and the awning cleaning tool is fully assembled and attached to the portable or truck-mounted cleaning system, the technician is ready to clean the awning. To this end, in one implementation, the technician activates the portable or truck-mounted cleaning system and positions the cleaning head unit of the awning cleaning tool in an area of the awning that is to be cleaned first. In general, the cleaning head is moved around in a small area of the awning to effectuate the cleaning. More particularly, in one implementation, the cleaning head is positioned at the bottom corner of a region at the top of the awning. The technician then switches the control switch on the control handle to initiate the cleaning and pushes the cleaning head up to top of the awning. During cleaning, the water-detergent mixture is sprayed via the cleaning head unit nozzles onto the top surface of the awning and the cleaning head unit's rotating brushes work the water-detergent mixture into the material of the awning to dislodge the dirt and debris. In one version, the used water-detergent mixture, dirt and debris are extracted via the one or two extraction ports at the same time. Any excess water-detergent mixture is captured by the cleaning head unit's leak guard so that it does not run down and off the awning. In version where the used water-detergent mixture, dirt and debris are not extracted at the same time as the cleaning, once the top of the awning is reached, the technician switches the control switch to initiate the extraction and pulls the control head unit down over the area just cleaned. During extraction, the water-detergent mixture flow and possibly the brush rotation is stopped, and the vacuum is activated. Thus, as the technician pulls the cleaning head down over the just-cleaned area, the used water-detergent mixture (along with the removed dirt and debris) is vacuumed out of the awning material and into the cleaning head unit's extraction port. The technician then moves the cleaning head to an adjacent area on the top of the awning and repeats the foregoing cleaning/extraction process.

Once the top of the awning is cleaned, the technician moves the cleaning head unit to the next adjacent lower region of the awing and repeats the foregoing cleaning process. It is noted that in the case of an awning cleaning tool implementation using a segmented extension line, if the awning cleaning tool cannot be easily handled by the technician based on the number of extension line segments installed and how the technician is positioned, one or more of the installed extension line segments can be removed prior to cleaning each lower region of the awning. In one implementation, this entails turning off the portable or truck-mounted cleaning system, disconnecting the water-detergent feed line and the electrical supply lines from both ends of the segment being removed, and then removing the segment. Once the segment has been removed, the remaining portion of the tool having the control handle (which may or may not have an extension line segment attached) is connected to the remaining portion of the tool having the cleaning head unit (which may or may not have an extension line segment attached). The water-detergent feed line and the electrical supply line connections are made as described previously. In the case of an awning cleaning tool implementation using either a telescoping extension line or a telescoping support extension, if the awning cleaning tool cannot be easily handled by the technician based on the current length of the extension and how the technician is positioned, the extension is retracted in the manner described previously.

The awning cleaning process continues until the bottom region of the awning is cleaned. In one implementation, the cleaning head unit is about 1 foot wide and it is envisioned that the technician can move the awning cleaning tool up and down about 4 feet. Thus, it is possible to clean a 1×4 foot area of the awning with each stroke. Given this, a 4×4-foot awning can be cleaned in 4 strokes (assuming no horizontal overlap) without having to remove any extension line segments. Likewise, an 8×8-foot awning can be cleaned by starting with the top half and using 8 strokes (assuming no horizontal overlap). The lower half of the awning would then be cleaned in the same manner—however an extension line segment may have to be removed, or the extension shortened, to clean the lower half. Awnings having other sizes would be cleaned in a similar manner using more or less strokes for each 4-foot "row" starting at the top of the awning, and if necessary an extension line segment would be removed, or the extension shortened, before moving down to the next "row". Of course, the cleaning head unit width can be smaller or larger than 1 foot, and the extension line segments can be more or less than 4 feet long. As such the width of each cleaning "column" can vary from the exemplary 1 foot, and the extent of each cleaning "row" can vary from the exemplary 4 feet. In addition, extension line segments of different length can be employed; overlapping stokes may be used; and to completely clean a "column" on the awning, more than one stroke may be needed. Thus, the number of strokes required to clean each "row" of the awning may vary from the examples given above, as can the necessity to remove an extension line segment, or shorten the extension, before moving down to the next "row".

It is further noted that, while rinsing is not typically required, the foregoing procedure for cleaning each "row" of the awning (or even after each stroke) can be repeated except using just water rather than the water-detergent mixture. It is also noted that as described previously, after the entire awning has been cleaned, a water repellant is typically sprayed onto the top surface of the awning using a standard pump sprayer device. The awning material needs to be relatively dry to apply the water repellant. The awning material may be dry enough owing to it being vacuumed during the cleaning process. Even so, the awning can be left to dry for a short period of time before applying the water repellant. For example, it can be left to dry for the period of time it takes for the technician to disassemble the awning cleaning tool and stow the parts.

2.0 Other Advantages and Implementations

While the awning cleaning tool has been described by specific reference to implementations thereof, it is understood that variations and modifications thereof can be made without departing from the true spirit and scope. For example, while the foregoing awning cleaning tool is employed to clean awnings, it can also be used to clean other structures employing awning-like material. For example, the awning cleaning tool could be used to clean various marine structures, such as boat sails.

In addition, in the foregoing description of the various awning cleaning tool implementations, the water-detergent feed lines and their associated connectors were described as being on a particular side of the awning cleaning tool, and the electrical supply lines and their associated connectors were described as being on the other side of the awning cleaning tool. However, the side of the awning cleaning tool on which the lines and connectors reside can be reversed. It is further noted that the interface connectors for the body of the extension line segment (or telescoping body), water-detergent feed line and electrical supply line can be any conventional connector type, although in one implementation these interface connectors are of a quick-disconnect type. The same is true of the interface connectors on the cleaning head unit described previously and the control handle. It is noted that in the figures, the interface connectors of the extension line, cleaning head unit and control handle, appear as either female or male connectors. However, it is not intended that the awning cleaning tool be limited to the depicted male/female configuration. Rather, the interface connectors depicted as male can instead be female, and the interface connectors that are depicted as female can instead be male. Further, interface connectors may be employed that cannot be characterized as either male or female. In general, any appropriate water-detergent feed line interface connectors can be employed that allows the water-detergent mixture to flow through without leaking. In addition, generally any appropriate electrical supply line interface connectors can be employed that create an electrical connection between the interfacing segments (or the control handle or the cleaning head unit), as well as protect the electrical wiring from moisture and physical damage. It is further noted that the coupling between the previously described vacuum extension line and the control handle and/or cleaning head unit can be accomplished using a conventional rotating lock cam. Still further, while the implementations of the extensions, water-detergent feed lines, electrical supply lines, and the various connectors and couplings described so far can be interpreted as having a circular cross-section, this need not be the case. Any cross-sectional shape is feasible, such as square, rectangular, triangular, oval, and so on.

It is further noted that in any of the awning cleaning tool implementations described previously, the extension line, water-detergent feed line and electrical supply line combination; or the support extension, vacuum line, water-detergent feed line and electrical supply line combination; could be made short enough that when connected between the cleaning head unit and control handle, the awning cleaning tool takes the form a handheld tool. In this handheld form, the technician would hold the tool by the control handle and manipulate the cleaning head as if the cleaning head unit were directly attached to the control handle. This would make close-in cleaning much easier. While an implementation where the cleaning head unit is connected directly to the control handle is also envisioned and within the scope of the awning cleaning tool described herein, the implementation employing a short extension connection scheme has the advantage of allowing a longer extension to be switched in and out with the shorter extension version without affecting the configuration of the cleaning head unit or the control handle.

It is further noted that any or all of the implementations that are described in the present document and any or all of the implementations that are illustrated in the accompanying drawings may be used and thus claimed in any combination desired to form additional hybrid implementations. In addition, although the subject matter has been described in language specific to structural features and/or methodological acts, it is to be understood that the subject matter defined in any appended claims is not necessarily limited to the specific features or acts described above. Rather, the specific features and acts described above are disclosed as example forms of implementing any appended claims.

What has been described above includes example implementations. It is, of course, not possible to describe every conceivable combination of components or methodologies for purposes of describing the subject matter of any appended claim, but one of ordinary skill in the art may recognize that many further combinations and permutations are possible. Accordingly, the subject matter of any appended claim is intended to embrace all such alterations, modifications, and variations that fall within the spirit and scope of any appended claims.

Wherefore, what is claimed is:

1. An awning cleaning tool, comprising:

a cleaning head unit comprising a downward-facing side having a proximal end and a distal end, which faces an awning surface that is to be cleaned, said cleaning head unit further comprising, a vacuum extension line connector interface located on the cleaning head unit adjacent the proximal end of the unit's downward-facing side, a water-detergent feed line connector interface located on the cleaning head unit adjacent the proximal end of the unit's downward-facing side, an electrical supply line connector interface located on the cleaning head unit adjacent the proximal end of the unit's downward-facing side, a leak guard that runs laterally across the downward-facing side of the cleaning head unit at the proximal end thereof and which projects outward from the downward-facing side of the cleaning head unit further than any other protuberance on the downward-facing side of the cleaning head unit to ensure that it touches the awning material whenever the cleaning head unit is in operation, one or more brushes that run laterally across the downward-facing side of the cleaning head unit forward of the leak guard toward the distal end of the downward-facing side and which project outward from the downward-facing side of the cleaning head unit, a row of water-detergent applicator nozzles that run laterally across the downward-facing side of the cleaning head unit forward of the one or more brushes toward the distal end of the downward-facing side of the cleaning head unit, and an elongated extraction port that run laterally across the downward-facing side of the cleaning head unit forward of the nozzles at the distal end of the downward-facing side;

an extension line which is coupled at a first end to said vacuum extension line connector interface via an extension line vacuum coupling, to said water-detergent feed line connector interface via an extension line water-detergent feed line coupling, and to said electrical supply line connector interface via an extension line electrical supply line coupling; and a control handle, comprising couplings at a first end of the control handle which couple to the a second end of the extension line, comprising a control handle vacuum line coupling which is coupled to a second extension line vacuum coupling, a control handle water-detergent feed line coupling which is coupled to a second extension line water-detergent feed line coupling, and a control handle electrical supply line coupling which is coupled to a second extension line electrical supply line coupling, and whenever an awning surface is to be cleaned, the control handle is further coupled at a second end, to a vacuum line via a second control handle vacuum line coupling, wherein said vacuum line is capable of applying a vacuum which draws liquid into the cleaning head unit extraction port and pulls the extracted liquid through the cleaning head unit, extension line and control handle and out of the second control handle vacuum line coupling, to a water-detergent feed line via a second control handle water-detergent feed line coupling, wherein said water-detergent feed line is capable of pumping water or a water-detergent mixture through the control handle, extension line and cleaning head unit and out of the applicator nozzles, and to an electrical supply line via a second control handle electrical supply line coupling, wherein the electrical supply line is capable of supplying electrical power to the cleaning head unit, and a control switch that that activates a cleaning mode.

2. The awning cleaning tool of claim 1, wherein the one or more brushes, comprises a single cylindrical brush which rotates about central hub on a plane that is perpendicular to the downward-facing side of the cleaning head unit, wherein the central hub is driven by an electric motor that is powered via an electrical line coming from the electrical supply line connector interface.

3. The awning cleaning tool of claim 1, wherein each of the applicator nozzles is replaceable and exhibits a spray angle and spray pattern that is different from at least one of the other applicator nozzles.

4. The awning cleaning tool of claim 1, wherein the leak guard is replaceable, is comprised of a flexible, durable material having a concave shape that faces the distal end of the cleaning head unit.

5. The awning cleaning tool of claim 1, wherein the extension line comprises a fold-down handle located on the extension line closer to the control handle than the cleaning head unit, wherein the fold-down handle is extended so that it projects radially out from the side of the extension line during cleaning operations to provide a hand-hold for an operator and assist the operator in controlling the awning cleaning tool, and wherein the fold-down handle is retracted against the extension line when the awning cleaning tool is not in use for ease in storage.

6. The awning cleaning tool of claim 1, wherein the control handle switches between a first position that activates said cleaning mode and a second position that activates an extraction mode, wherein the water-detergent feed line and electrical supply line are activated but the vacuum line is not active in the cleaning mode, and wherein the vacuum line is activated but the water-detergent feed line and electrical supply line are not active in the extraction mode.

7. The awning cleaning tool of claim 1, wherein the control handle switches between a first position that activates said cleaning mode and a second position that activates an extraction mode, wherein the water-detergent feed line and electrical supply line are activated but the vacuum line is not active in the cleaning mode, and wherein the vacuum line and electrical supply line are activated but the water-detergent feed line is not active in the extraction mode.

8. The awning cleaning tool of claim 1, wherein the control handle switches between a first position that activates said cleaning mode and a second position that activates a neutral mode, wherein the vacuum line, water-detergent feed line and electrical supply line are activated in the cleaning mode, and wherein the vacuum line, the water-detergent feed line and electrical supply line are not active in the neutral mode.

9. An awning cleaning tool, comprising:

a cleaning head unit comprising a downward-facing side having a proximal end and a distal end, which faces an awning surface that is to be cleaned, said cleaning head unit further comprising, a vacuum extension line connector interface located on the cleaning head unit adjacent the proximal end of the unit's downward-facing side, a water-detergent feed line connector interface located on the cleaning head unit adjacent the proximal end of the unit's downward-facing side, an electrical supply line connector interface located on the cleaning head unit adjacent the proximal end of the unit's downward-facing side, a leak guard that runs laterally across the downward-facing side of the cleaning head unit at the proximal end thereof and which projects outward from the downward-facing side of the cleaning head unit further than any other protuberance on the downward-facing side of the cleaning head unit to ensure that it touches the awning material whenever the cleaning head unit is in operation, one or more brushes that run laterally across the downward-facing side of the cleaning head unit forward of the leak guard toward the distal end of the downward-facing side and which project outward from the downward-facing side of the cleaning head unit, a row of water-detergent applicator nozzles that run laterally across the downward-facing side of the cleaning head unit forward of the one or more brushes toward the distal end of the downward-facing side of the cleaning head unit, and an elongated extraction port that run laterally across the downward-facing side of the cleaning head unit forward of the nozzles at the distal end of the downward-facing side;

a tube-shaped, telescoping extension made of a rigid material which is attached at a first end to said cleaning head unit;

a cleaning tool vacuum line which is coupled at a first end to said vacuum extension line connector interface via a cleaning tool vacuum line coupling;

a cleaning tool water-detergent feed line which is coupled to said water-detergent feed line connector interface via a cleaning tool water-detergent feed line coupling;

a cleaning tool electrical supply line which is coupled to said electrical supply line connector interface via a cleaning tool electrical supply line coupling; and a control handle which is attached to a second end of the telescoping extension, said control handle comprising, a control handle vacuum line coupling which is coupled to a second cleaning tool vacuum line coupling, a control handle water-detergent feed line coupling which is coupled to a second cleaning tool water-detergent feed line coupling, and a control handle electrical supply line coupling which is coupled to a second cleaning tool electrical supply line coupling, and whenever an awning surface is to be cleaned, the control handle is further coupled at a second end, to a vacuum line via a second control handle vacuum line coupling, wherein said vacuum line is capable of applying a vacuum which draws liquid into the cleaning head unit extraction port and pulls the extracted liquid through the cleaning head unit, extension line and control handle and out of the second control handle vacuum line coupling, to a water-detergent feed line via a second control handle water-detergent feed line coupling, wherein said water-detergent feed line is capable of pumping water or a water-detergent mixture through the control handle, extension line and cleaning head unit and out of the applicator nozzles, and to an electrical supply line via a second control handle electrical supply line coupling, wherein the electrical supply line is capable of supplying electrical power to the cleaning head unit, and a control switch that activates a cleaning mode.

10. The awning cleaning tool of claim 9, wherein the telescoping extension is releasably attached at the first end to the cleaning head unit via one of (i) a hinge joint that allows the cleaning head unit to pivot in relation to the telescoping extension in the pitch direction, or (ii) a locking hinge joint that allows the cleaning head unit to pivot in relation to the telescoping extension in the pitch direction, said locking hinge joint comprising a releasable lock that whenever engaged retains the then existing angle between the cleaning head unit and the telescoping extension and whenever released allows the cleaning head unit to pivot in relation to the telescoping extension, or (iii) a swivel joint that allows the cleaning head unit to pivot in relation to the telescoping extension in at least one of pitch or yaw or roll directions, or (iv) a locking swivel joint that allows the cleaning head unit to pivot in relation to the telescoping extension in at least one of pitch or yaw or roll directions, said locking swivel joint comprising a releasable lock that whenever engaged retains the then existing angle between the cleaning head unit and the telescoping extension and whenever released allows the cleaning head unit to pivot in relation to the telescoping extension.

11. The awning cleaning tool of claim 9, wherein the telescoping extension is releasably attached at the second end to the control handle.

12. An awning cleaning tool, comprising:

a cleaning head unit comprising a downward-facing side having a proximal end and a distal end, which faces an awning surface that is to be cleaned, said cleaning head unit further comprising, a leak guard that runs laterally across the downward-facing side of the cleaning head unit at the proximal end thereof and which projects outward from the downward-facing side of the cleaning head unit further than any other protuberance on the downward-facing side of the cleaning head unit to ensure that it touches the awning material whenever the cleaning head unit is in operation, one or more brushes that run laterally across the downward-facing side of the cleaning head unit forward of the leak guard toward the distal end of the downward-facing side and which project outward from the downward-facing side of the cleaning head unit, a row of water-detergent applicator nozzles that run laterally across the downward-facing side of the cleaning head unit forward of the one or more brushes toward the distal end of the downward-facing side of the cleaning head unit, and an elongated extraction port that run laterally across the downward-facing side of the cleaning head unit forward of the nozzles at the distal end of the downward-facing side;

an extension line comprising an extension line vacuum line, an extension line water-detergent feed line, and an extension line electrical supply line, each of which is connected at a first end to the cleaning head unit; and a control handle which is connected, at a first end to a second end of the extension line vacuum line, a second end of the extension line water-detergent feed line and a second end of the extension line electrical supply line, and whenever an awning surface is to be cleaned, the control handle is further connected at a second end, to a vacuum line which is capable of applying a vacuum which draws liquid into the cleaning head unit extraction port and pulls the extracted liquid through the cleaning head unit, extension line and control handle, to a water-detergent feed line which is capable of pumping water or a water-detergent mixture through the control handle, extension line and cleaning head unit and out of the applicator nozzles, and to an electrical supply line which is capable of supplying electrical power to the cleaning head unit, and a control switch that activates a cleaning mode.

* * * * *